US010907460B2

(12) United States Patent
Marsh

(10) Patent No.: US 10,907,460 B2
(45) Date of Patent: Feb. 2, 2021

(54) ENERGETIC CHARGE FOR PROPELLANT FRACTURING

(71) Applicant: The Johns Hopkins University, Baltimore, MD (US)

(72) Inventor: Bruce D. Marsh, Hunt Valley, MD (US)

(73) Assignee: The Johns Hopkins University, Baltimore, MD (US)

( * ) Notice: Subject to any disclaimer, the term of this patent is extended or adjusted under 35 U.S.C. 154(b) by 384 days.

(21) Appl. No.: 15/894,760

(22) Filed: Feb. 12, 2018

(65) Prior Publication Data

US 2019/0249533 A1 Aug. 15, 2019

(51) Int. Cl.

| | |
|---|---|
| ***E21B 43/26*** | (2006.01) |
| ***E21B 43/263*** | (2006.01) |
| ***E21B 43/247*** | (2006.01) |
| ***E21B 49/00*** | (2006.01) |
| ***E21B 41/00*** | (2006.01) |
| ***E21B 47/002*** | (2012.01) |
| ***E21B 43/11*** | (2006.01) |
| ***E21B 29/02*** | (2006.01) |

(52) U.S. Cl.

CPC ..... *E21B 43/263* (2013.01); *E21B 29/02* (2013.01); *E21B 41/0092* (2013.01); *E21B 43/11* (2013.01); *E21B 43/247* (2013.01); *E21B 43/26* (2013.01); *E21B 47/002* (2020.05); *E21B 49/00* (2013.01)

(58) Field of Classification Search

CPC ..... E21B 29/02; E21B 43/11; E21B 43/26; E21B 43/263; F42D 3/04; F24B 1/00; F24B 3/00

USPC ..... 102/311–314, 332

See application file for complete search history.

(56) References Cited

U.S. PATENT DOCUMENTS

| | | | | |
|---|---|---|---|---|
| 4,039,030 A | | 8/1977 | Godfrey et al. | |
| 4,548,252 A | * | 10/1985 | Stowe | E21B 43/263 166/299 |
| 5,295,545 A | * | 3/1994 | Passamaneck | E21B 43/263 166/299 |
| 6,389,361 B1 | | 5/2002 | Geiser | |

(Continued)

FOREIGN PATENT DOCUMENTS

| | | |
|---|---|---|
| WO | WO 00/23821 | 4/2000 |

OTHER PUBLICATIONS

International Search Report and Written Opinion for Application No. PCT/US2019/014247, dated May 30, 2019, 8 pages.

(Continued)

*Primary Examiner* — Tara Schimpf

(74) *Attorney, Agent, or Firm* — Harrity & Harrity, LLP

(57) ABSTRACT

An energetic charge for propellant fracturing may include a propellant material or a shape of the energetic charge being selected such that a rise time of a deflagration of the energetic charge is determined to be in the propellant fracturing regime. The propellant fracturing regime may be defined by a set of linear equations associated with the rise time for pressure from the deflagration of the energetic charge. The rise time may be calculated based on an equation $\dot{\varepsilon}=(dP/dt)/E$, where $\dot{\varepsilon}$ represents a strain rate, dP/dt represents a change in pressure with respect to time, and E is Young's modulus, and where the set of linear equations relate the rise time to a borehole diameter.

20 Claims, 13 Drawing Sheets

(56) References Cited

U.S. PATENT DOCUMENTS

| | | | | |
|---|---|---|---|---|
| 8,186,435 | B2 | 5/2012 | Seekford | |
| 9,075,158 | B2 | 7/2015 | Geiser | |
| 9,389,326 | B2 | 7/2016 | Vermilye et al. | |
| 9,447,672 | B2 | 9/2016 | Arrell, Jr. et al. | |
| 9,726,157 | B2 | 8/2017 | Sweatman et al. | |
| 10,024,145 | B1 * | 7/2018 | Schmidt | E21B 43/117 |
| 2006/0047431 | A1 | 3/2006 | Geiser | |
| 2007/0251615 | A1 | 11/2007 | Amtower | |
| 2009/0183916 | A1 * | 7/2009 | Pratt | E21B 43/117 175/2 |
| 2012/0243368 | A1 | 9/2012 | Geiser et al. | |
| 2013/0128694 | A1 | 5/2013 | Lacazette et al. | |
| 2013/0201787 | A1 | 8/2013 | Vermilye et al. | |
| 2013/0341029 | A1 | 12/2013 | Roberts et al. | |
| 2014/0288840 | A1 | 9/2014 | Vermilye et al. | |
| 2015/0354859 | A1 | 12/2015 | Marsh et al. | |
| 2016/0084055 | A1 | 3/2016 | Moore et al. | |
| 2016/0084059 | A1 | 3/2016 | Moore et al. | |
| 2016/0231444 | A1 | 8/2016 | Lacazette et al. | |
| 2017/0031048 | A1 | 2/2017 | Hilpert et al. | |
| 2017/0138164 | A1 | 5/2017 | Mace et al. | |

OTHER PUBLICATIONS

Geothermal Manhattan Project (GMP), "The Use of Energetics for Fracking—High Strain Rate vs. Large Volume", A White Paper Prepared for Shell Oil Company, Apr. 23, 2015, 92 pages.

Cuderman, "Multiple Fracturing Experiments—Propellant and Borehole Considerations", 1984, 14 pages.

Jaeger et al., "Fundamentals of Rock Mechanics", 1979, 489 pages.

* cited by examiner

460

460

900

ENERGETIC CHARGE FOR PROPELLANT FRACTURING

BACKGROUND

Hydraulic fracturing may be used as a well stimulation technique. For example, a pressurized liquid may be injected into a rock formation to fracture the rock formation. Based on fracturing the rock formation, natural resources, such as natural gas, oil, and/or the like, may be extracted from the rock formation. Propellant fracturing may be used as an alternative to hydraulic fracturing to reduce cost, improve an amount of a natural resource that is extracted, enable natural resource extraction when pressured liquid pumping equipment is unavailable or installation is infeasible, and/or the like. In propellant fracturing, an energetic charge is positioned in a rock formation, and may be ignited to fracture the rock formation. Ignition of the energetic charge may cause a change in pressure inside the rock formation, which may cause fractures to propagate.

SUMMARY

According to some possible implementations, an energetic charge for propellant fracturing may include a propellant material or a shape of the energetic charge being selected such that a rise time of a deflagration of the energetic charge is determined to be in the propellant fracturing regime. The propellant fracturing regime may be defined by a set of linear equations associated with the rise time for pressure from the deflagration of the energetic charge. The rise time may be calculated based on an equation $\dot{\varepsilon}=(dP/dt)/E$, where $\dot{\varepsilon}$ represents a strain rate, dP/dt represents a change in pressure with respect to time, and E is Young's modulus, and where the set of linear equations relate the rise time to a borehole diameter.

According to some possible implementations, a non-transitory computer-readable medium storing instructions, the instructions comprising one or more instructions that, when executed by one or more processors of a device coupled to an energetic charge, cause the one or more processors to determine a first configuration for a first deflagration of the energetic charge; transmit, to the energetic charge, a first signal associated with triggering the first deflagration of the energetic charge in a borehole at a location for propellant fracturing based on the first configuration; communicate with one or more sensor devices associated with the location for propellant fracturing to obtain sensor data regarding the first deflagration of the energetic charge; determine a second configuration for a second deflagration of the energetic charge based on the sensor data; and transmit, to the energetic charge, a second signal associated with triggering the second deflagration of the energetic charge.

According to some possible implementations, a device may include one or more memories and one or more processors communicatively coupled to the one or more memories. The one or more memories and the one or more processors may be configured to determine one or more characteristics associated with a location for propellant fracturing; determine a rise time to achieve propellant fracturing at the location based on the one or more characteristics; identify a plurality of candidate energetic charge configurations for an energetic charge to perform propellant fracturing; select, from the plurality of candidate energetic charge configurations, a particular energetic charge configuration based on the rise time to achieve propellant fracturing and the one or more characteristics associated with the location; and provide information identifying the particular energetic charge configuration based on selecting the particular energetic charge configuration.

DETAILED DESCRIPTION

Figure 1:
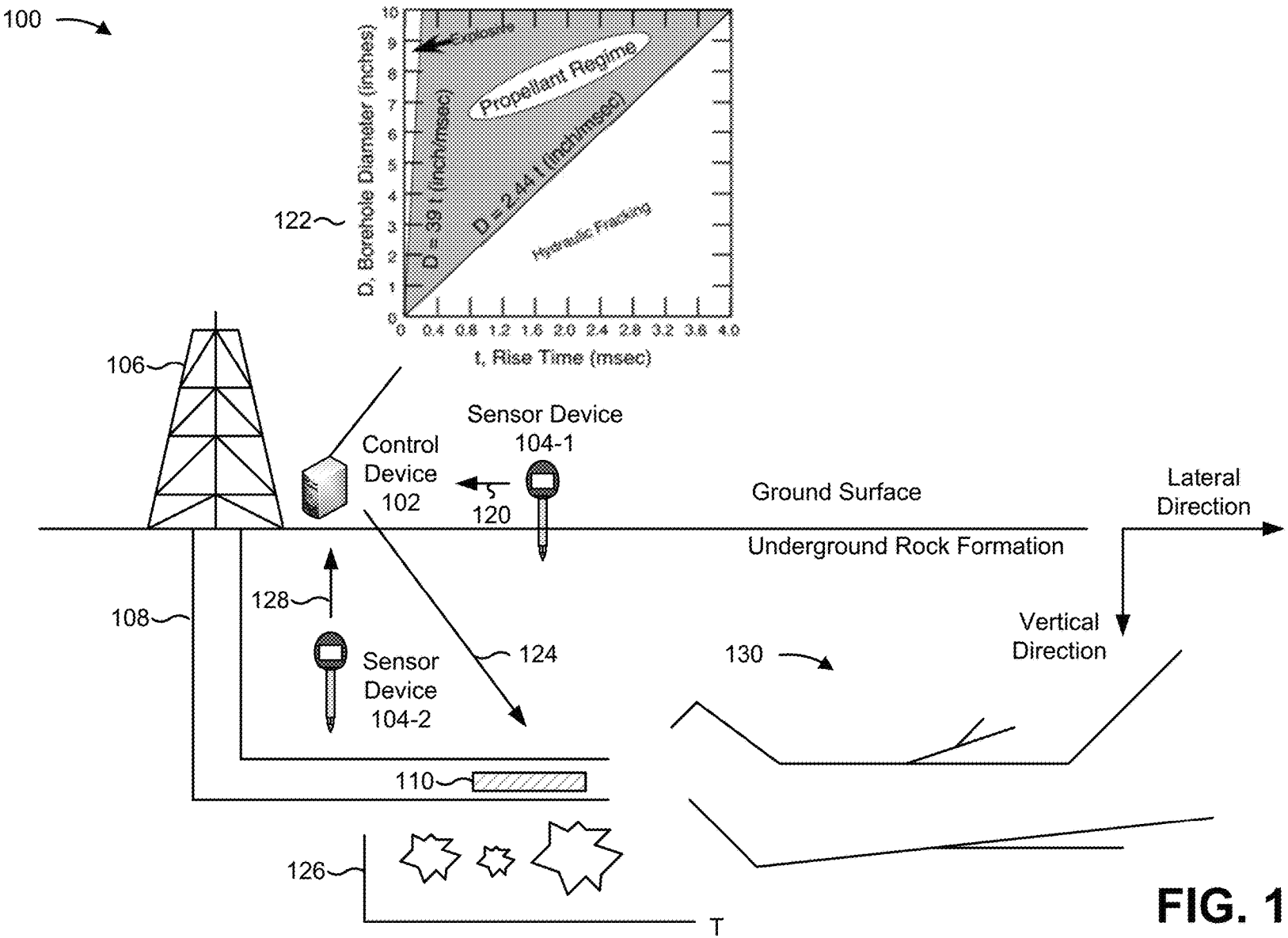
FIG. 1 is a diagram of an overview of an example implementation described herein.

The following detailed description of example implementations refers to the accompanying drawings. The same reference numbers in different drawings may identify the same or similar elements.

Fracturing techniques, such as hydraulic fracturing, propellant fracturing, explosive fracturing, and/or the like may be used to enable natural resource extraction from a rock formation. For example, in hydraulic fracturing, a pressurized liquid may be injected into a borehole to fracture a rock formation and enable extraction of natural gas from the rock formation. However, hydraulic fracturing may require excessive surface infrastructure and may result in excessive cost to achieve extraction of natural resources. For example, hydraulic fracturing may require a fluid storage facility, an injection device, a pumping device, monitoring equipment, and/or the like. Moreover, hydraulic fracturing may be associated with a threshold amount of water utilization. Furthermore, hydraulic fracturing may be associated with relatively poor control of fracture propagation (e.g., directional control, length control, and/or the like) and excessive time to achieve fracture propagation.

Propellant fracturing may be used to achieve natural resource extraction with reduced cost and reduced surface infrastructure requirements. In propellant fracturing, a rapid burning or deflagration procedure may be used to create fractures in a rock formation. However, poor control of the deflagration procedure for propellant fracturing may result in the energetic charge causing hydraulic fracturing or explosive fracturing to be performed rather than propellant fracturing. When hydraulic fracturing is performed, limitations associated with hydraulic fracturing may be present, such as poor control of fracture propagation, excessive time to achieve fracture propagation, and/or the like. Similarly, when explosive fracturing is performed, fractures may be resealed by rock that is crushed by the explosive deflagration. Some techniques for propellant fracturing may result in relatively short fractures, such as fractures of less than 15 meters.

Some implementations, described herein, provide techniques to configure and control propellant fracturing to ensure that the resultant fracturing does not act as explosive fracturing or hydraulic fracturing. For example, some implementations described herein may enable strain rate control to achieve propellant fracturing using a controlled deflagration (i.e., a rapid burning). Moreover, some implementations, described herein, provide techniques to configure and control propellant fracturing to achieve a threshold fracture length. In this way, some implementations, described herein, improve natural resource extraction, increase fracture length, increase control of fracture propagation (e.g., directional control, length control, and/or the like), decrease time to achieve fracture propagation, reduce utilization of propellant material for the energetic charge, reduce energy consumption, and/or the like relative to other techniques for propellant fracturing and/or relative to hydraulic fracturing or explosive fracturing.

FIG. 1 is a diagram of an overview of an example implementation 100 described herein. As shown in FIG. 1, example implementation 100 includes a control device 102, a set of sensor devices 104, and a borehole platform 106.

As further shown in FIG. 1, a borehole 108 may be drilled from borehole platform 106 into an underground rock formation. For example, borehole 108 may be drilled vertically with respect to a ground surface and the underground rock formation, laterally with respect to the ground surface and the underground rock formation, a combination of vertically and laterally with respect to the ground surface and the underground rock formation, and/or the like. In some implementations, control device 102 may determine the diameter of the borehole based on a rise time calculation to ensure propellant fracturing, as described herein. An energetic charge 110 may be positioned in borehole 108. For example, a solid fuel based energetic charge may be positioned in borehole 108 (e.g., a homogeneous solid, a heterogeneous solid, a pellet based solid, and/or the like), a gel fuel based energetic charge may be positioned in borehole 108, a gaseous fuel based energetic charge may be positioned in borehole 108, and/or the like. In some implementations, control device 102 may configure energetic charge 110 based on a rise time calculation to ensure propellant fracturing, as described herein. For example, control device 102 may select a material for energetic charge 110, a shape for energetic charge 110, a casing for energetic charge 110, and/or the like.

As further shown in FIG. 1, and by reference number 120, control device 102 may receive sensor data from sensory device 104-1. For example, control device 102 may receive imaging data, seismographic data, and/or the like regarding the underground rock formation. As shown by reference number 122, control device 102 may determine one or more parameters relating to deflagration of an energetic charge for propellant fracturing. For example, control device 102 may determine the borehole size for borehole 108, the rise time for pressure from the deflagration, a configuration for igniting energetic charge 110, and/or the like to ensure that the deflagration results in propellant fracturing rather than hydraulic fracturing or explosive fracturing, as described herein.

As further shown in FIG. 1, and by reference number 124, control device 102 may provide a control signal to energetic charge 110. For example, based on a determined rise time, control device 102 may ignite energetic charge 110, a portion of energetic charge 110, and/or the like. In some implementations, control device 102 may transmit the control signal to one or more ignition devices to ignite multiple selected portions of energetic charge 110, multiple energetic charges 110 (e.g., concurrently, sequentially, etc.), and/or the like.

In some implementations, control device 102 may provide a single control signal to cause a single ignition. For example, based on configuring a multi-stage energetic charge 110, control device 102 may ignite the multi-stage energetic charge 110 which may be designed to control the rise time using the multiple stages. In this case, as shown by reference number 126, over a period of time, multiple ignition stages may occur using energetic charge 110. Additionally, or alternatively, and as shown by reference number 128, control device 102 may receive sensor data from sensor device 104-2, such as sensor data identifying a change in pressure resulting from deflagration, and may transmit another control signal to an ignition device of energetic charge 110 (e.g., to perform another ignition, to halt another ignition, and/or the like based on the sensor data). As shown by reference number 130, ignition of energetic charge 110 may cause a set of fractures to be achieved in the underground rock formation, thereby enabling natural resource extraction.

In this way, control device 102 enables propellant fracturing by using sensor data to calculate a rise time for pressure associated with a deflagration of energetic charge 110 and to control the deflagration of energetic charge 110. Moreover, control device 102 enables increased fracture length relative to other techniques for propellant fracturing by configuring energetic charge 110 based on a rise time calculation. For example, control device 102 may enable fracture lengths of greater than approximately 15 meters, approximately 20 meters, approximately 25 meters, approximately 50 meters, approximately 100 meters, and/or the like. Furthermore, control device 102 enables increased control of fracture propagation based on sensor data identifying stress fields in the underground rock formations.

As indicated above, FIG. 1 is provided merely as an example. Other examples are possible and may differ from what was described with regard to FIG. 1.

Figure 2:
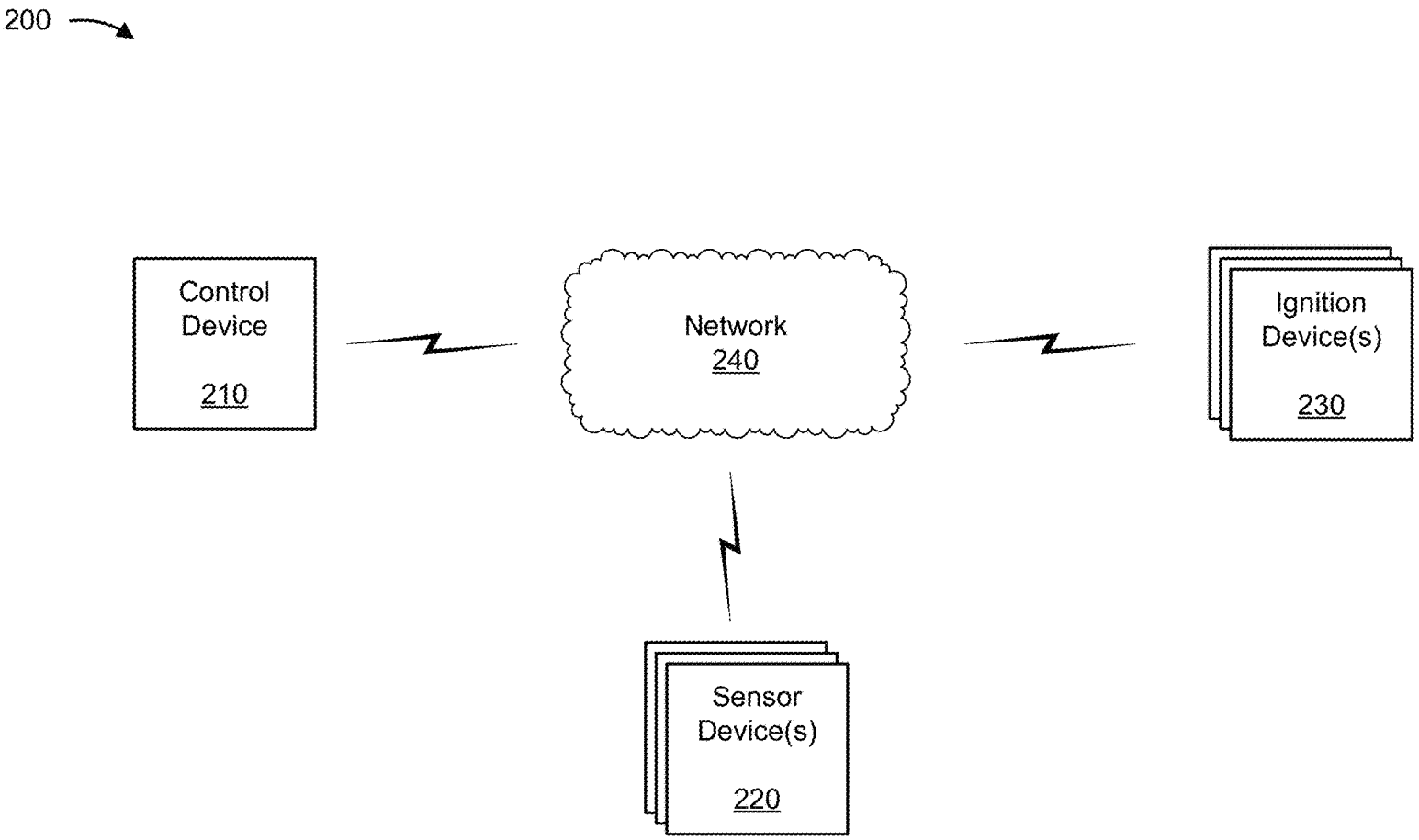
FIG. 2 is a diagram of an example environment in which systems and/or methods, described herein, may be implemented.

FIG. 2 is a diagram of an example environment 200 in which systems and/or methods, described herein, may be implemented. As shown in FIG. 2, environment 200 may include a control device 210, one or more sensor devices 220, an ignition device 230, a network 240, and/or the like. Devices of environment 200 may interconnect via wired connections, wireless connections, or a combination of wired and wireless connections.

Control device 210 includes one or more devices capable of receiving, generating, storing, processing, and/or providing information associated with controlling propellant fracturing. For example, control device 210 may include a communication and/or computing device, such as a computer (e.g., a laptop computer, a desktop computer, a tablet computer), a mobile phone (e.g., a smartphone), a server, a wearable communication device (e.g., a smart wristwatch), and/or the like. In some implementations, control device 210 may store information identifying a range of acceptable rise time values for a set of borehole configurations, thereby enabling control device 210 to determine a rise time for a selected borehole. Additionally, or alternatively, control device 210 may determine a rise time, an energetic charge configuration, a borehole configuration, and/or the like based on characteristics of a rock formation in which fracturing is to occur.

Sensor device 220 includes one or more devices capable of receiving, generating, storing, processing, and/or providing sensor data associated with controlling propellant fracturing. For example, sensor device 220 may include an imaging sensor or sensor array (e.g., to image a geologic formation, such as an underground rock formation and an ambient stress field of the underground rock formation), a seismic sensor, a pressure sensor, a propellant flow rate sensor (e.g., to determine a flow rate of a propellant being injected into a borehole or a fracture), a borehole diameter sensor, a material sensor (e.g., to automatically detect a type of material in an energetic charge or a rock formation), a spectrometer (e.g., to automatically detect a type of material in an energetic charge or a rock formation), and/or the like.

In some implementations, a single sensor device 220 may include multiple sensors, such as an imaging sensor, a pressure sensor, a seismic sensor, and the like. In some implementations, sensor device 220 may be activated at different stages of propellant fracturing, such as performing an initial sensing before propellant fracturing to enable configuration of propellant fracturing, an ongoing sensing during propellant fracturing to enable control of propellant fracturing, a final sensing after propellant fracturing to enable a determination of a final state of affected geologic formations and facilitate resource extraction, and/or the like. In some implementations, sensor device 220 may provide sensor data in real time or near-real time (e.g., in less than a threshold period of time from data collection, such as less than 1 minute, less than 10 seconds, less than 1 second, less than 0.1 seconds, less than 0.01 seconds, and/or the like. In this way, sensor device 220 may enable control device 210 to control an initial deflagration or an ongoing deflagration by utilizing information regarding existing rock types and ambient stress fields. Moreover, based on controlling the deflagrations, control device 210 may reduce propellant use, increase fracturing length, improve natural resource extraction, and/or the like relative to an uncontrolled deflagration.

Ignition device 230 includes one or more devices capable of igniting an energetic charge. For example, ignition device 230 may include an electrical igniter to ignite a solid fuel energetic charge, a pellet based energetic charge, a gaseous fuel based energetic charge, a gel based energetic charge, and/or the like. In some implementations, a single ignition device 230 may ignite multiple portions of an energetic charge, such as multiple layers, multiple locations of a common layer, and/or the like. In some implementations, a group of ignition devices 230 may be deployed to ignite multiple portions of the energetic charge.

Network 240 includes one or more wired and/or wireless networks. For example, network 240 may include a cellular network (e.g., a long-term evolution (LTE) network, a code division multiple access (CDMA) network, a 3G network, a 4G network, a 5G network, another type of next generation network, etc.), a public land mobile network (PLMN), a local area network (LAN), a wide area network (WAN), a metropolitan area network (MAN), a telephone network (e.g., the Public Switched Telephone Network (PSTN)), a private network, an ad hoc network, an intranet, the Internet, a fiber optic-based network, a cloud computing network, or the like, and/or a combination of these or other types of networks. In some implementations, network 240 may include a signaling connection. For example, network 240 may include an electrical connection between control device 210 and ignition device 230 and/or the like.

The number and arrangement of devices and networks shown in FIG. 2 are provided as an example. In practice, there may be additional devices and/or networks, fewer devices and/or networks, different devices and/or networks, or differently arranged devices and/or networks than those shown in FIG. 2. Furthermore, two or more devices shown in FIG. 2 may be implemented within a single device, or a single device shown in FIG. 2 may be implemented as multiple, distributed devices. Additionally, or alternatively, a set of devices (e.g., one or more devices) of environment 200 may perform one or more functions described as being performed by another set of devices of environment 200.

Figure 3:
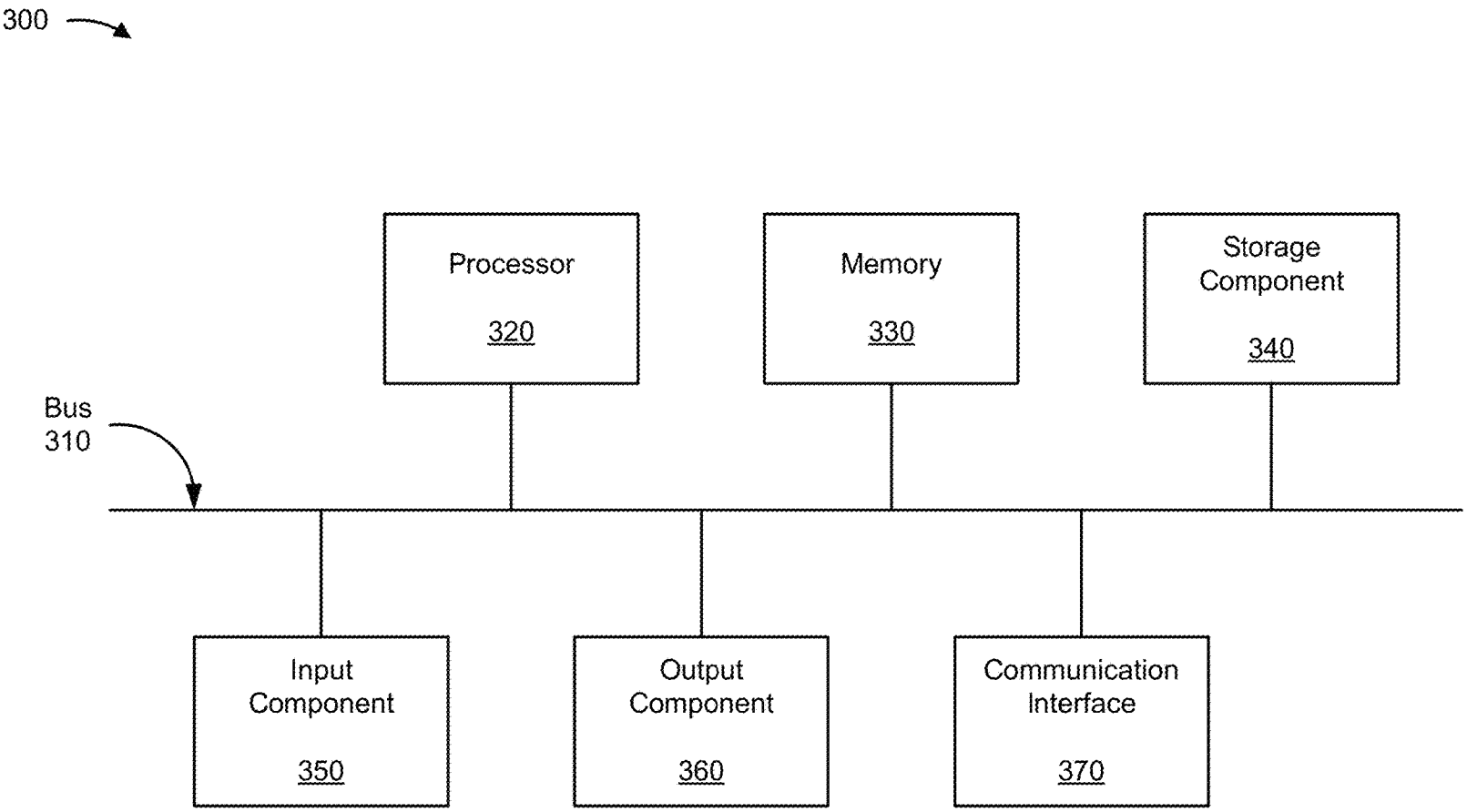
FIG. 3 is a diagram of example components of one or more devices of FIG. 2.

FIG. 3 is a diagram of example components of a device 300. Device 300 may correspond to control device 210, sensor device 220, ignition device 230, and/or the like. In some implementations, control device 210, sensor device 220, ignition device 230, and/or the like may include one or more devices 300 and/or one or more components of device 300. As shown in FIG. 3, device 300 may include a bus 310, a processor 320, a memory 330, a storage component 340, an input component 350, an output component 360, and a communication interface 370.

Bus 310 includes a component that permits communication among the components of device 300. Processor 320 is implemented in hardware, firmware, or a combination of hardware and software. Processor 320 is a central processing unit (CPU), a graphics processing unit (GPU), an accelerated processing unit (APU), a microprocessor, a microcontroller, a digital signal processor (DSP), a field-programmable gate array (FPGA), an application-specific integrated circuit (ASIC), or another type of processing component. In some implementations, processor 320 includes one or more processors capable of being programmed to perform a function. Memory 330 includes a random access memory (RAM), a read only memory (ROM), and/or another type of dynamic or static storage device (e.g., a flash memory, a magnetic memory, and/or an optical memory) that stores information and/or instructions for use by processor 320.

Storage component 340 stores information and/or software related to the operation and use of device 300. For example, storage component 340 may include a hard disk (e.g., a magnetic disk, an optical disk, a magneto-optic disk, and/or a solid state disk), a compact disc (CD), a digital versatile disc (DVD), a floppy disk, a cartridge, a magnetic tape, and/or another type of non-transitory computer-readable medium, along with a corresponding drive.

Input component 350 includes a component that permits device 300 to receive information, such as via user input (e.g., a touch screen display, a keyboard, a keypad, a mouse, a button, a switch, and/or a microphone). Additionally, or alternatively, input component 350 may include a sensor for sensing information (e.g., a global positioning system (GPS) component, an accelerometer, a gyroscope, and/or an actuator). Output component 360 includes a component that provides output information from device 300 (e.g., a display, a speaker, and/or one or more light-emitting diodes (LEDs)).

Communication interface 370 includes a transceiver-like component (e.g., a transceiver and/or a separate receiver and transmitter) that enables device 300 to communicate with other devices, such as via a wired connection, a wireless connection, or a combination of wired and wireless connections. Communication interface 370 may permit device 300 to receive information from another device and/or provide information to another device. For example, communication interface 370 may include an Ethernet interface, an optical interface, a coaxial interface, an infrared interface, a radio frequency (RF) interface, a universal serial bus (USB) interface, a Wi-Fi interface, a cellular network interface, or the like.

Device 300 may perform one or more processes described herein. Device 300 may perform these processes based on processor 320 executing software instructions stored by a non-transitory computer-readable medium, such as memory 330 and/or storage component 340. A computer-readable medium is defined herein as a non-transitory memory device. A memory device includes memory space within a single physical storage device or memory space spread across multiple physical storage devices.

Software instructions may be read into memory 330 and/or storage component 340 from another computer-readable medium or from another device via communication interface 370. When executed, software instructions stored in memory 330 and/or storage component 340 may cause processor 320 to perform one or more processes described herein. Additionally, or alternatively, hardwired circuitry may be used in place of or in combination with software instructions to perform one or more processes described herein. Thus, implementations described herein are not limited to any specific combination of hardware circuitry and software.

The number and arrangement of components shown in FIG. 3 are provided as an example. In practice, device 300 may include additional components, fewer components, different components, or differently arranged components than those shown in FIG. 3. Additionally, or alternatively, a set of components (e.g., one or more components) of device 300 may perform one or more functions described as being performed by another set of components of device 300.

Figure 4A:
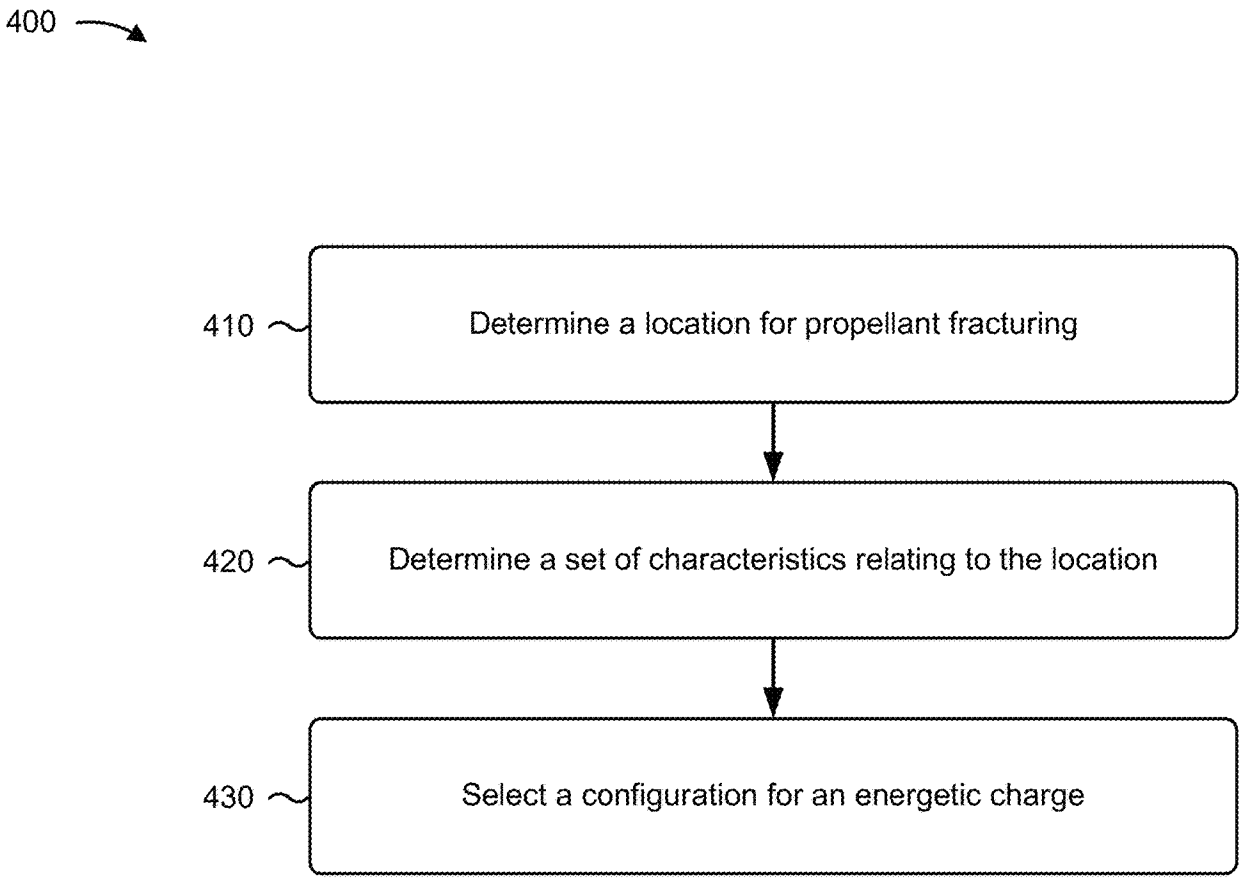
FIG. 4A is a flow chart of an example process for configuring an energetic charge for propellant fracturing.
Figure 4B:
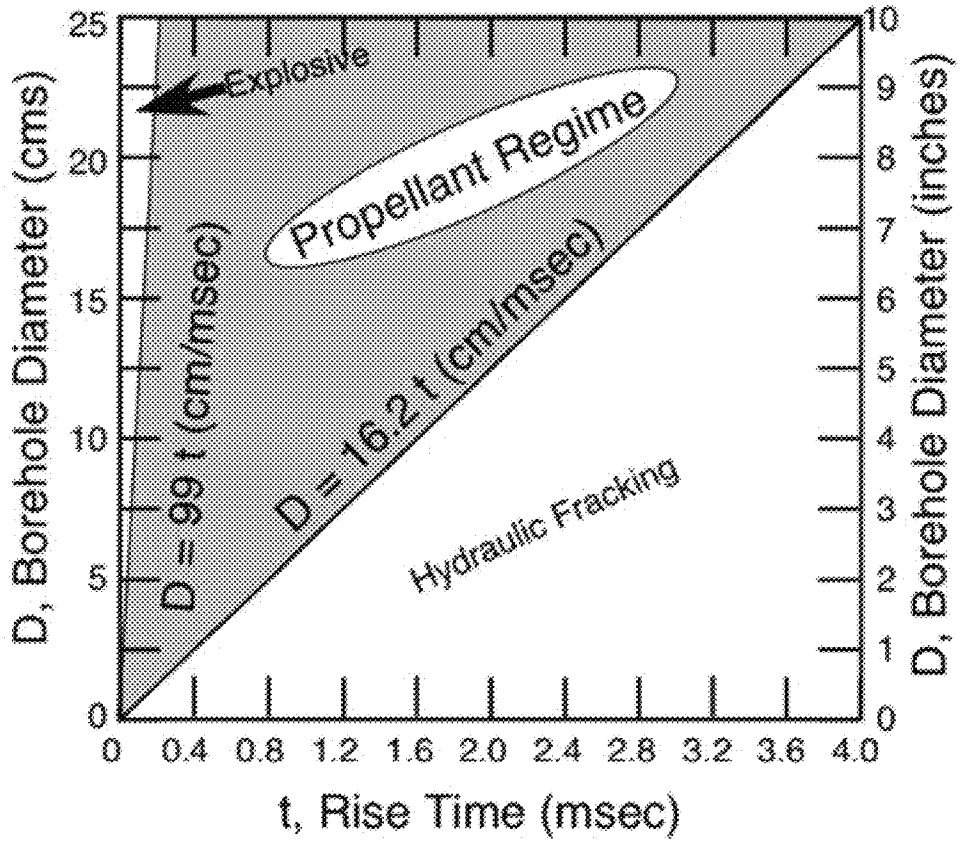
FIGS. 4B and 4C are diagrams of example characteristics relating to propellant fracturing.
Figure 4C:
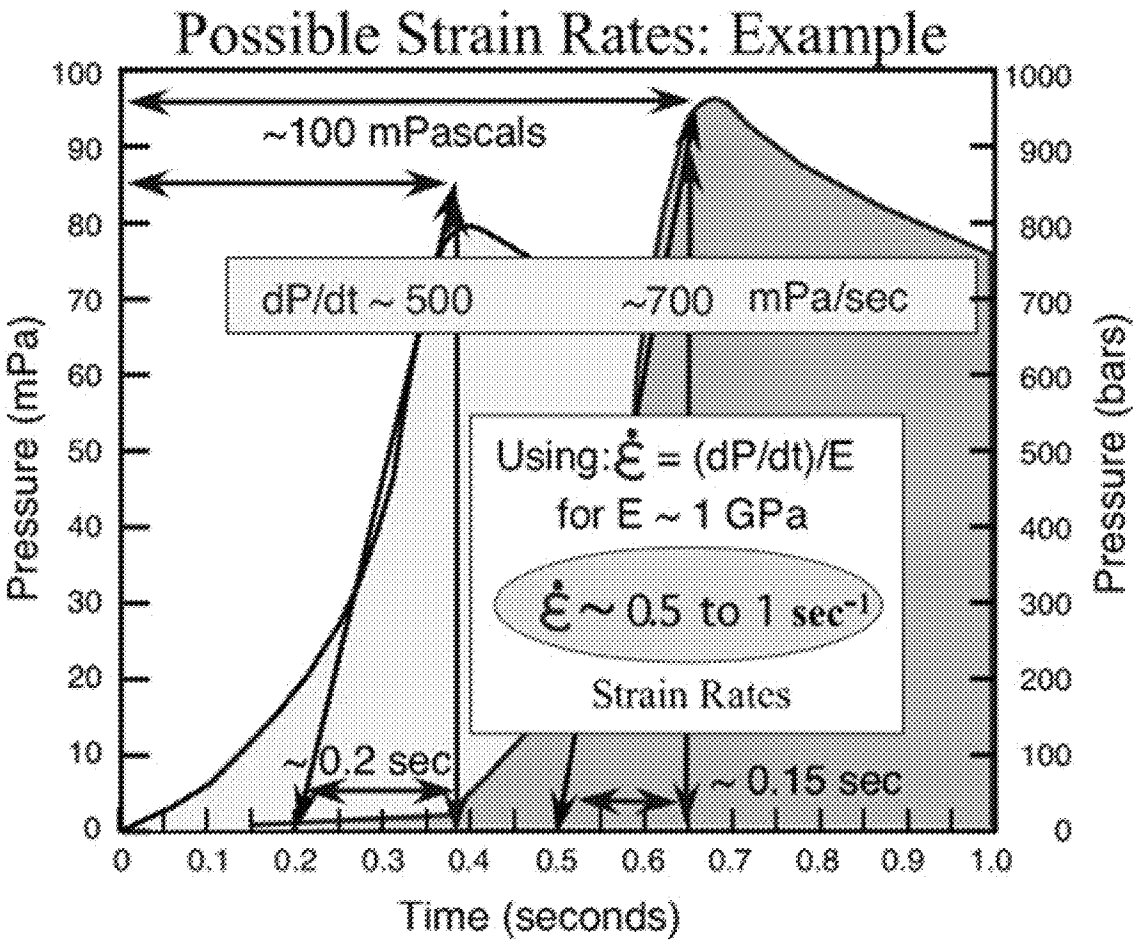

FIG. 4A is a flow chart of an example process 400 for configuring an energetic charge for propellant fracturing. In some implementations, one or more process blocks of FIG. 4A may be performed by control device 210. In some implementations, one or more process blocks of FIG. 4A may be performed by another device or a group of devices separate from or including control device 210, such as sensor device 220, ignition device 230, and/or the like. FIGS. 4B and 4C are diagrams of example characteristics relating to propellant fracturing.

As shown in FIG. 4A, process 400 may include determining a location for propellant fracturing (block 410). For example, control device 210 may determine the location for propellant fracturing. In some implementations, control device 210 may receive information identifying the location for propellant fracturing. For example, control device 210 may provide a user interface for display via a display device, and may detect input to the user interface associated with identifying the location for propellant fracturing. Additionally, or alternatively, control device 210 may obtain information identifying the location from a data structure. For example, control device 210 may determine that a data structure stores information identifying a set of candidate locations for propellant fracturing and may select one or more of the candidate locations as the location for propellant fracturing.

In some implementations, control device 210 may automatically determine the location for propellant fracturing. For example, control device 210 may determine one or more characteristics regarding a set of candidate locations, and may select one or more of the set of candidate locations as the location based on the one or more characteristics. In this case, control device 210 may determine characteristics, such as geologic characteristics, natural resources characteristics, land use characteristics, and/or the like based on sensor data from sensors 220, stored data from a data structure, and/or the like.

In some implementations, control device 210 may generate a score for the set of candidate locations based on the one or more characteristics. For example, control device 210 may determine or receive a weighting for evaluating each of the one or more characteristics, and may determine a score for each candidate location based on the weighting and the one or more characteristics. In this case, control device 210 may select a location as the location for propellant fracturing based on the score (e.g., based on the score being highest relative to other scores, based on the score satisfying a threshold value, based on the score being in a threshold percentile of scores, and/or the like). In some implementations, control device 210 may automatically determine the location for propellant fracturing based on an artificial intelligence technique, such as based on using a neural network, a heuristic, a machine learning technique, and/or the like to evaluate one or more characteristics associated with one or more locations.

In some implementations, control device 210 may determine the location based on sensor data. For example, control device 210 may determine a location of control device 210, of a sensor 220, of a user device used by an engineer or technician, and/or the like based on sensor data (e.g., positioning data), and may select the location as the location for propellant fracturing. In some implementations, control device 210 may determine a group of locations for propellant fracturing, such as a threshold area in which propellant fracturing is to be performed. In some implementations, control device 210 may determine a depth for propellant fracturing. For example, control device 210 may determine that the location is to be a particular depth below ground level, sea level, and/or the like. In some implementations, control device 210 may determine a characteristic as the location for propellant fracturing. For example, control device 210 may determine that the location for propellant fracturing is a location with a particular geologic characteristic (e.g., a particular rock formation type), and may configure the energetic charge for use in locations with the particular geologic characteristic without a priori information identifying the locations with the particular geologic characteristic.

In this way, control device 210 determines the location for propellant fracturing.

As further shown in FIG. 4A, process 400 may include determining a set of characteristics relating to the location (block 420). For example, control device 210 may determine the set of characteristics relating to the location. In some implementations, control device 210 may determine a geologic characteristic relating to the location. For example, control device 210 may determine a type of rock formation at the location, a group of rock formations at the location, a layering of rock formations at the location, a characteristic ambient stress field conducive to fracture initiation, a characteristic relating to seismic activity at the location, a permeability of rock at the location, and/or the like. In some implementations, control device 210 may determine a natural resource characteristic relating to the location. For example, control device 210 may determine a type of natural resource that is to be extracted at the location, a density of the natural resource at the location, and/or the like. In some implementations, control device 210 may determine a usage characteristic relating to the location. For example, control device 210 may determine a characteristic relating to a borehole at the location, an existing fracture at the location, an availability of equipment at the location, and/or the like.

In some implementations, control device 210 may determine a restriction characteristic relating to the location. For example, control device 210 may determine a characteristic relating to a sound restriction, a seismic restriction, a presence of an aquafer, and/or the like. In some implementations, control device 210 may determine a land use characteristic relating to the location, such as a characteristic relating to a portion of the location that is available or not available for borehole drilling, natural resource extraction, and/or the like.

In this way, control device 210 determines the set of characteristics relating to the location.

As further shown in FIG. 4, process 400 may include selecting a configuration for an energetic charge (block 430). For example, control device 210 may select the configuration for the energetic charge. In some implementations, control device 210 may select the configuration from a set of candidate configurations. For example, control device 210 may store information, in a data structure, identifying a set of candidate configurations for energetic charges and a set of characteristics for locations at which to use each of the set of candidate configurations for energetic charges, and may select a particular candidate configuration based on the characteristics for the location.

In some implementations, control device 210 may determine the configuration for the energetic charge based on a rise time determination. For example, control device 210 may determine a rise time for a borehole at the location to ensure propellant fracturing occurs (rather than hydraulic fracturing or explosive fracturing), and may determine a configuration for the energetic charge to achieve the determined rise time. In some implementations, the energetic charge may be a solid rocket fuel propellant based energetic charge. For example, control device 210 may select a cylindrical mass of solid rocket fuel that is to cause a deflagration. In this case, when ignition occurs, a pressure, P, increases in the borehole based on a density of the propellant in the energetic charge, a presence of air or water in the borehole or surrounding the energetic charge, and/or the like, which may affect a rate of change of P with respect to time (i.e., dP/dt). In some implementations, control device 210 may use sensor data relating to the location at which propellant fracturing is to occur to calculate dP/dt for a particular energetic charge configuration and select an energetic charge configuration that causes a dP/dt value that results in propellant fracturing occurring (rather than hydraulic fracturing or explosive fracturing). For example, control device 210 may determine in situ stress as a result of Hooke's Law (1):

$$\sigma = E\varepsilon \tag{1}$$

where $\sigma$ represents a stress in the rock formation, E represents an elastic constant, and $\varepsilon$ represents strain in the rock formation. In this case, applying Hooke's Law to the rate of change of pressure, $dP/dt = d\sigma/dt$, control device 210 may determine that for normal stress, radial to the borehole, $\sigma$ corresponds to P and thus:

$$\dot{\varepsilon} = \frac{dP}{dt}/E \tag{2}$$

which may indicate that both rise time and the magnitude of the pressure are to be controlled for the energetic charge (e.g., either based on selection of the energetic charge as described herein or control of deflagration of the energetic charge during deflagration as described herein). Based on determining a value for dP/dt and configuring the energetic charge to achieve the determined value (e.g., either initially when selecting an energetic charge or during deflagration of the energetic charge when determining whether to increase a magnitude of deflagration, a rate of pulsing the deflagration, and/or the like, as described herein), control device 210 may achieve fracturing in a desired orientation, to a threshold length, and/or the like.

In some implementations, control device 210 may calculate a rise time to ensure that propellant fracturing occurs according to a set of equations:

$$t_C < t_P < t_H \tag{3}$$

$$\frac{\pi D}{2C_R} < t_P < \frac{8\pi D}{C_R} \tag{4}$$

$$C_R = C_o(\mu * \rho)^{1/2} \tag{5}$$

where $t_C$ represents a rise time for explosive fracturing, $t_P$ represents a rise time for propellant fracturing, $t_H$ represents a rise time for hydraulic fracturing, D represents a borehole diameter (e.g., between approximately 0.01 meters (m) and approximately 0.25 m), and $C_R$ represents a shear wave velocity (e.g., approximately 1 kilometer (km)/second (s)), $C_o$ represents an order unity constant determined experimentally to be approximately 0.9, $\mu$ represents a rigidity value and $\rho$ represents a density value. In this way, control device 210 can calculate a rise time, and may select an energetic charge to achieve the calculated rise time or to enable control to achieve the rise time (e.g., an energetic charge with a particular configuration that enables control during the deflagration to achieve the necessary rise time based on sensor data identifying characteristics of the deflagration). For example, control device 210 may determine a rise time of between approximately 0.1 milliseconds and approximately 1.6 milliseconds.

In some implementations, as shown in FIG. 4B and by diagram 460, based on rise time being a function of borehole diameter and shear wave velocity, control device 210 may use a set of linear equations to calculate rise time. For example for a borehole diameter of between, for example, 0 meters (m) and 0.25 m and a potential rise time of between 0 milliseconds (ms) and 4 ms, control device 210 may represent a propellant fracturing regime as being bounded by the linear equations:

$$D = M * t \tag{6}$$

$$D = N * t \tag{7}$$

where M represents a first coefficient (e.g., 99) and N represents a second coefficient (e.g., 16.2) and which may be seen in FIG. 4B, which shows the propellant fracturing regime bounded by the set of linear equations. In this case, coefficients for the linear equation (e.g., 99 and 16.2) may be determined experimentally and/or may relate to particular characteristics of a particular geography. Thus, although implementations, described herein, are described in terms of a particular set of coefficients for the linear equations representing the propellant fracturing regime boundaries, implementations described herein may be used in connection with propellant fracturing regimes associated with other sets of linear equations and/or coefficients thereof.

In some implementations, control device 210 may select an energetic charge configuration to ensure that a deflagration of an energetic charge associated with the energetic charge is in the propellant fracturing regime. In this way, control device 210 reduces computing complexity (e.g., utilization of memory resources to store information and processing resources to calculate information) by using linear equations to solve for a borehole configuration and an energetic charge configuration to achieve propellant fracturing relative to other techniques that use more complicated types of equations or experimentally derived information.

As further shown in FIG. 4B, control device 210 may determine, for example and for a 0.25 m borehole, a rise time of between approximately 0.2 ms and 4 ms, and may select an energetic charge to cause the determined rise time or to enable control to achieve the determined rise time. Similarly, for a 0.1 m borehole, control device 210 may determine a rise time of between approximately 0.1 ms and approximately 1.6 ms. In this way, control device 210 determines a rise time to select an energetic charge that causes a threshold strain rate to propagate fractures in a rock formation.

As shown in FIG. 4C, control device 210 may determine a strain rate based on a value for dP/dt. For example, as shown in FIG. 4C, a value for dP/dT may be approximately 500 to 700 millipascals (mPa)/sec for a set of burns of 0.2 seconds and 0.15 seconds to peak pressure may be used for propellant fracturing. In this way, multiple pulsed burns may be used to achieve a desired pressure to cause propellant fracturing based on a configured rise time for the pressure. Although described herein in terms of a strain rate chart, some implementations described herein may use another data representation technique, such as a set of equations, a table of values, and/or the like for determining a desired strain rate, pressure, burn time, and/or the like.

In some implementations, control device 210 may determine a particular type of propellant to use for the energetic charge based on a borehole diameter, a characteristic of a rock formation, a desired fracture propagation length, and/or the like. For example, control device 210 may select an energetic charge with an energy density of between approximately 100 Joules (J)/kilogram (kg) and approximately 50 megaJoules (MJ)/kg. In this case, volume of a fracture created by an energetic charge may be proportional to energy expended by a propellant, enabling selection of a propellant type based on a desired fracture propagation volume or length. For example, control device 210 may determine:

$$R=K_o\sqrt{A_T/L} \tag{8}$$

where R represents an effective fracture length (e.g., based on a flattened ellipse profile for a fracture), $K_o$ represents an experimentally derived constant (e.g., between approximately $10^{-3}$ and $5\times10^{-4}$), $A_T$ represents the propellant energy per kilogram, and L represents a length of propellant that is to be positioned in a borehole.

In some implementations, control device 210 may determine:

$$R=\left(\frac{W*E}{P_O^2}\right)^{1/2}*(\pi(1-\nu^2))^2 \tag{9}$$

where R represents a fracture length, W represents propellant energy per unit length, $P_o$ represents pressure in a fracture, ν represents Poisson's ratio, and E represents Young's modulus, thereby enabling control device 210 to select a propellant associated with a value for W that achieves a desired fracture length, R. In this way, control device 210 may determine a pressure to achieve a desired fracture length.

In some implementations, control device 210 may determine the stress due to an induced temperature change:

$$\sigma\sim\frac{E\alpha(\Delta T)}{(1-\nu)} \tag{10}$$

where α represents a coefficient of thermal expansion for a rock formation and ΔT represents an induced temperature change in the rock formation from a deflagration using an energetic charge. In this case, control device 210 may determine a change to a yield stress of the rock formation resulting from a temperature change from the deflagration. Propagation of temperature change may be determined as:

$$L\sim(\kappa t)^{1/2} \tag{11}$$

where L represents a temperature propagation length, κ represents a thermal diffusivity constant, and t represents time for propagation. From this, control device 210 may determine an effect of thermal temperature change on crack propagation, which may be greater than a threshold effect (e.g., greater than 1% effect, 2% effect, 5% effect, 10% effect, 20% effect, and/or the like) within a threshold distance of the borehole (e.g., within 1 meter, within 0.1 meters, within 0.01 meters, within 0.001 meters, within 0.0001 meters, within 0.0000001 meters, and/or the like), but a negligible effect greater than the threshold distance (e.g., greater the 0.0000001 meters, greater than 0.0001 meters, greater than 0.001 meters, greater than 0.01 meters, greater than 0.1 meters, greater than 1 meter, greater than 10 meters, and/or the like.

In some implementations, control device 210 may determine an effect of gas production from a candidate energetic charge configuration to determine whether to select the candidate energetic charge configuration for propellant fracturing. For example, control device 210 may determine:

$$P(t)=\frac{H}{s}(\exp(C_1*S*t)-1) \tag{12}$$

$$C_1=(\rho A)\left(\frac{R*T_o}{M*V_o}\right) \tag{13}$$

where P(t) represents a change in pressure relative to time t; H represents a burn rate of the propellant in a vacuum; S represents a slope of the burn rate; and $C_1$ represents a constant relating to pressure, ρ, cross-sectional area of the energetic charge, A, rate of burning, R, temperature of the burning energetic charge, To, average molecular weight of the gas produced by burning the energetic charge, M, and free volume between the energetic charge and a wall of the borehole, $V_o$.

In some implementations, control device 210 may determine a shape for the energetic charge. For example, control device 210 may determine that the energetic charge is to be a cylindrical energetic charge for a cylindrical borehole. In some implementations, control device 210 may determine that the energetic charge is to be associated with a casing, such as a solid casing to direct fracture propagation out axially from a cylindrical energetic charge, a perforated casing with multiple perforations to direct fracture propagation out radially from a cylindrical energetic charge, and/or the like. In this way, by using a perforated casing, control device 210 may enable an energetic charge to propagate fractures tangentially to a direction of a borehole. For example, a vertical borehole may be used with a perforated casing energetic charge to propagate lateral fractures, thereby reducing drilling complexity and cost relative to requiring the borehole to be drilled both vertically and laterally to enable lateral fracture propagation.

In some implementations, control device 210 may determine a set of stages (also termed "phases" or "pulses") for the energetic charge (e.g., to achieve a determined rise time), and may select the configuration for the energetic charge based on the set of stages. For example, control device 210 may determine a configuration for the energetic charge that results in multiple periods of deflagration, thereby enabling achievement of the determined rise time. Moreover, based on configuring multiple stages alternating with multiple pauses (e.g., a time between each stage when the deflagration is not occurring or is occurring with reduced energy release), control device 210 may enable fluid in a rock formation (e.g., brine) to flow into fractures created and/or propagated by each stage (e.g., as a result of a pressure gradient in the rock formation). In this case, when a deflagration occurs with brine already in the fracture, a propagation of the fracture is increased relative to deflagration without a fluid at a leading edge of a pressure wave corresponding to the deflagration. In some implementations, a time between deflagration stages may be a threshold period of time that corresponds to an amount of time for fluid to enter a fracture after a deflagration stage. In this way, by hydraulic hammering of the rock formation, control device 210 enables improved fracture propagation. In some implementations, control device 210 may determine a timing associated with ensuring that fluid can enter fractures between stages based on characteristics of a rock formation, and may select a configuration for the energetic charge to achieve the determined timing.

In some implementations, control device 210 may determine a configuration for the energetic charge to enable portions of the energetic charge to be distributed into fractures. For example, control device 210 may select a particle based propellant that, after an initial stage to open a fracture, may be injected into the fracture and ignited inside the fracture to increase a length of the fracture relative to using a statically positioned energetic charge. Additionally, or alternatively, control device 210 may select a liquid based propellant for at least a portion of the energetic charge, and may cause the liquid based propellant to be injected into a fracture to extend a length of the fracture.

Additionally, or alternatively, control device 210 may determine a configuration for ignition device 230 associated with the configuration for the energetic charge. For example, control device 210 may determine a set of locations in or on the energetic charge to which ignition device 230 is to be coupled to enable ignition of one or more of the set of locations to achieve the determined rise time, as described herein. Based on determining the configuration for the energetic charge, control device 210 may provide information identifying the configuration, provide an automated instruction to cause the energetic charge to be manufactures, provide an automated instruction to cause the energetic charge to be inserted into a borehole, and/or the like.

In this way, control device 210 selects a configuration for the energetic charge.

Although FIG. 4A shows example blocks of process 400, in some implementations, process 400 may include additional blocks, fewer blocks, different blocks, or differently arranged blocks than those depicted in FIG. 4A. Additionally, or alternatively, two or more of the blocks of process 400 may be performed in parallel. As indicated above, FIGS. 4B and 4C are provided merely as an example. Other examples are possible and may differ from what was described with regard to FIGS. 4B and 4C.

Figure 5:
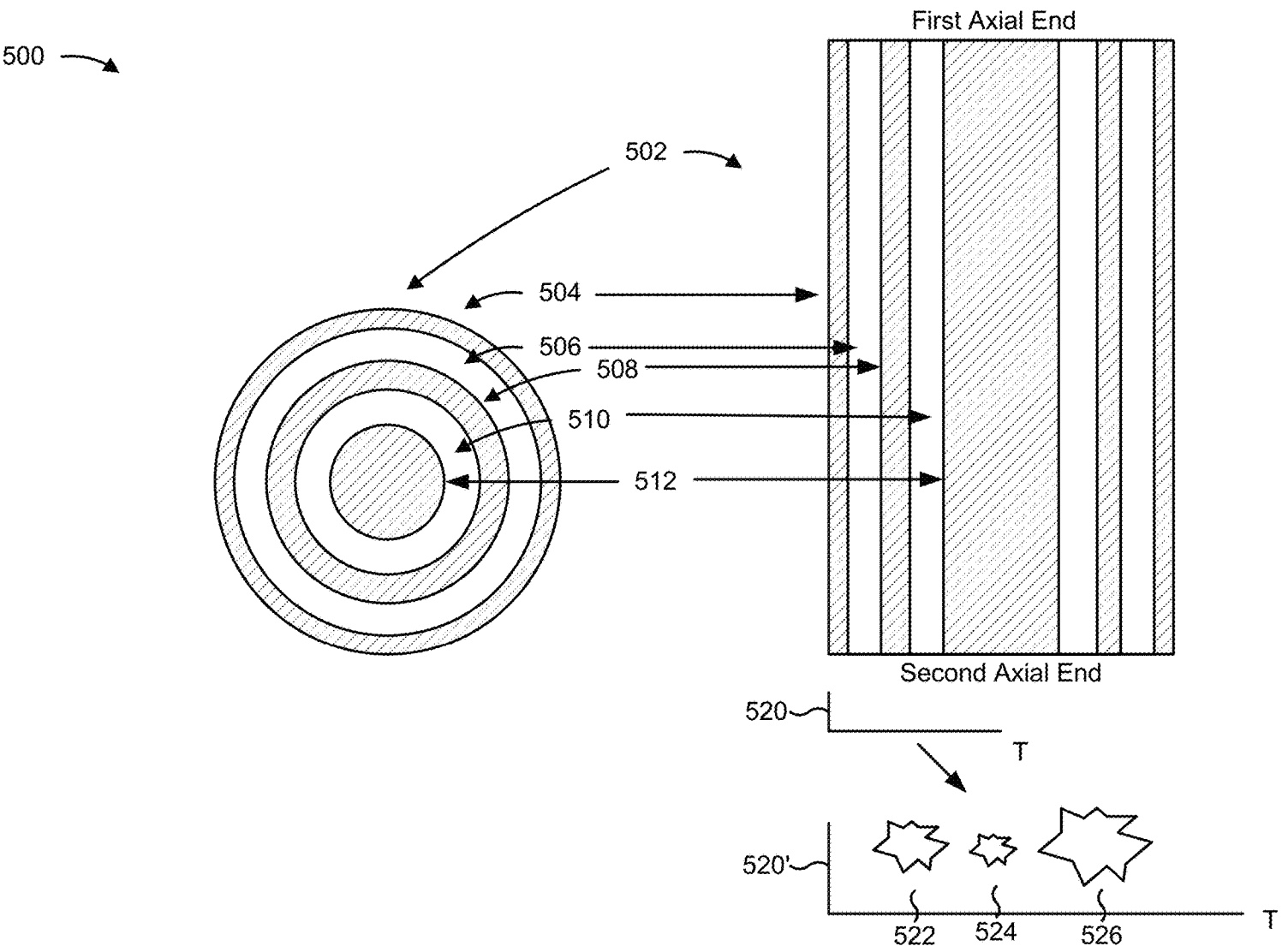
FIG. 5 is a diagram of an example implementation relating to the example process shown in FIG. 4.

FIG. 5 is a diagram of an example implementation 500 relating to example process 400 shown in FIG. 4. FIG. 5 shows an example of a selected energetic charge configuration.

As shown in FIG. 5, example implementation 500 includes an energetic charge 502. Energetic charge 502 may be a multi-stage energetic charge that is associated with multiple ignitions to achieve a determined rise time for a particular borehole diameter of a borehole into which energetic charge 502 is positioned. To achieve multiple ignitions, energetic charge 502 may include a set of layers 504 through 512. For example, energetic charge 502 may include a set of energetic layers 504, 508, and 512 to cause propellant fracturing, and a set of control layers 506 and 510 to enable a pause between energy releases associated with each of the set of energetic layers. For example, and as shown by reference numbers 520/520', ignition device 230 may ignite energetic layer 504 causing a first deflagration 522, followed by a control period associated with control layer 506, followed by a second deflagration 524 associated with energetic layer 508, followed by a control period associated with control layer 506, followed by a third deflagration 526 associated with energetic layer 512. In some implementations, the control period may be associated with a deflagration not occurring. In some implementations, the control period may be associated with a reduction in energy output from deflagration. In some implementations, a deflagration may be associated with a first threshold period of time of between approximately 0.0000001 seconds and approximately 10 seconds, a subinterval thereof, and/or the like and a control period may be associated with a second threshold period of time of between approximately 0.0000001 seconds and approximately 10 seconds, a subinterval thereof, and/or the like. Additionally, or alternatively, other periods of time may be used for deflagrations and/or control periods, such as greater than 10 second, greater than 100 seconds, and/or the like, less than 10 seconds, less than 1 second, less than 0.1 seconds, and/or the like.

Although described herein in terms of a group of cylindrical layers of a cylindrical energetic charge, some implementations described herein may use other configurations for an energetic charge to control rise time, such as a set of vertical layers in an energetic charge, a set of different regions in the energetic charge, a particular energetic material selected for the energetic charge to achieve a particular deflagration characteristic (e.g., a particular rise time), a particular amount of energy release, a particular direction of energy release, and/or the like.

In some implementations, energetic charge 502 may be associated with a casing, such as a solid casing with an opening at each axial end to enable axial propagation of a fracture, a perforated casing with radial openings to enable radial propagation of fractures, and/or the like. In some implementations, multiple energetic charges 502 may be used, such as multiple solid energetic charges 502 in a grid of boreholes or other arrangement of boreholes, a solid energetic charge 502 (e.g., to cause an initial fracture) and a liquid energetic charge 502 (e.g., to be injected into the initial fracture to further propagate the initial fracture), and/or the like.

As indicated above, FIG. 5 is provided merely as an example. Other examples are possible and may differ from what was described with regard to FIG. 5.

Figure 6:
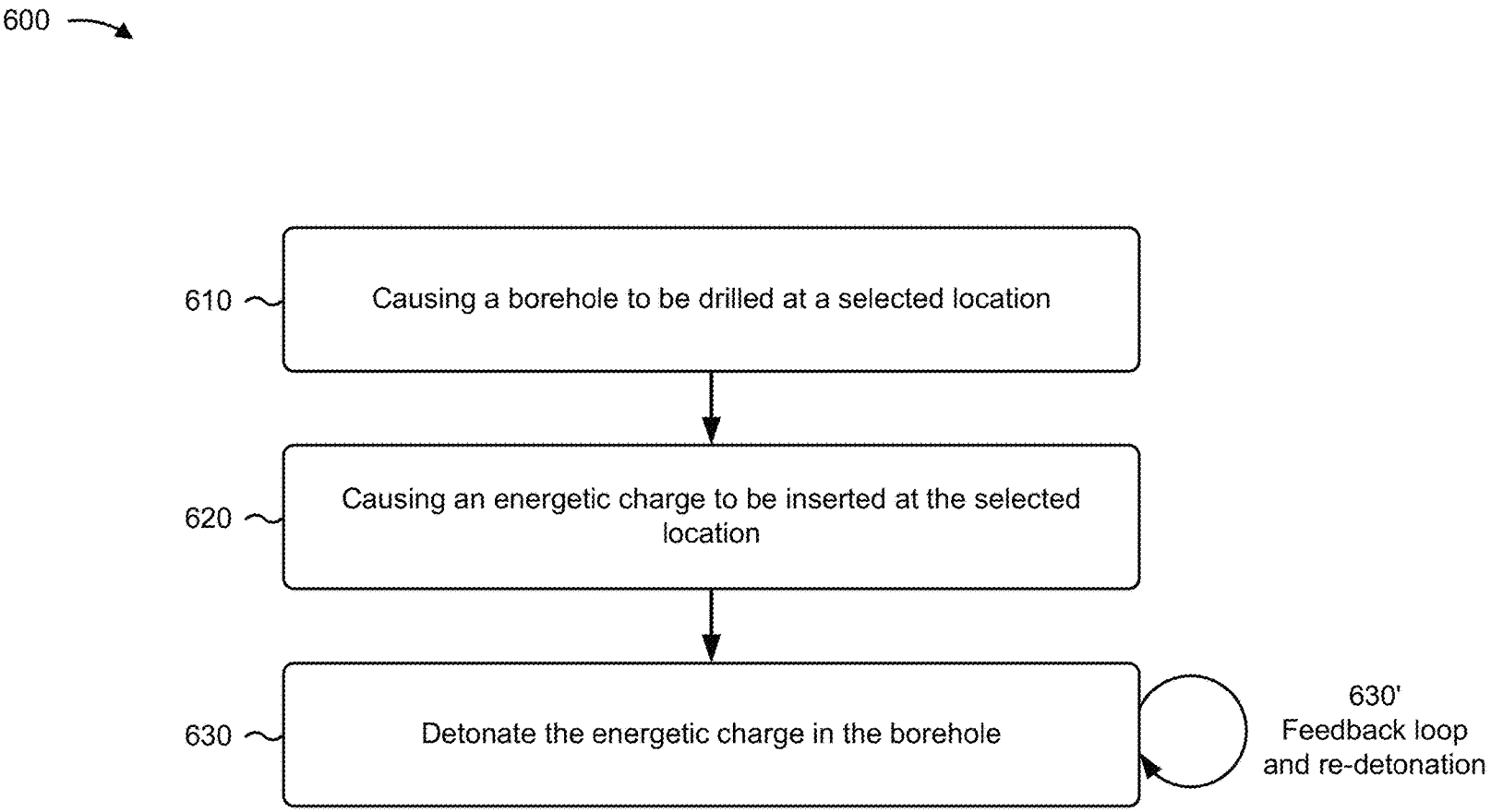
FIG. 6 is a flow chart of an example process for propellant fracturing.

FIG. 6 is a flow chart of an example process 600 for propellant fracturing. In some implementations, one or more process blocks of FIG. 6 may be performed by control device 210. In some implementations, one or more process blocks of FIG. 6 may be performed by another device or a group of devices separate from or including control device 210, such as sensor device 220, ignition device 230, and/or the like.

As shown in FIG. 6, process 600 may include causing a borehole to be drilled at a selected location (block 610). For example, a borehole may be drilled at the selected location based on an instruction from control device 210. In some implementations, control device 210 may transmit an instruction to a drilling device to cause the drilling device to drill a borehole at the selected location. Additionally, or alternatively, control device 210 may transmit an instruction identifying a borehole diameter for a particular energetic charge that is to be used for the location. In some implementations, control device 210 may provide output identifying a borehole diameter, a borehole shape, another parameter relating to a borehole, and/or the like to cause drilling of a borehole at the selected location. For example, control device 210 may provide a user interface for display via a display device identifying a vertical borehole, one or more lateral offshoots from the vertical borehole, and/or the like.

In this way, a borehole may be drilled at the selected location.

As further shown in FIG. 6, process 600 may include causing an energetic charge to be inserted at the selected location (block 620). For example, the energetic charge may be inserted into the borehole based on an instruction from control device 210. In some implementations, the energetic charge may be inserted into the borehole based on an instruction from control device 210. For example, control device 210 may transmit an instruction to surface machinery at the borehole to cause the energetic charge to be inserted into the borehole. Additionally, or alternatively, when the energetic charge is a gaseous energetic charge, a gel based energetic charge, and/or the like, control device 210 may transmit an instruction to cause the energetic charge to be pumped into the borehole at a particular pressure, with a particular volumetric flow rate, and/or the like.

In this way, the energetic charge may be inserted into the borehole.

As further shown in FIG. 6, process 600 may include detonating the energetic charge in the borehole (block 630), and, in some implementations, may include re-detonation based on a feedback loop (block 630'). For example, control device 210 may detonate the energetic charge in the borehole by transmitting an instruction to ignition device 230. In some implementations, control device 210 may detonate the energetic charge based on sensor data. For example, based on imaging data identifying a characteristic of a geologic formation, control device 210 may determine to detonate a portion of the energetic charge. In this case, control device 210 may receive imaging data identifying a fracture propagation, a change to a stress field, and/or the like, and may receive the imaging data in real-time, in near-real time (e.g., with a delay of less than 10 seconds, less than 1 second, less than 0.1 seconds, and/or the like), and may use the imaging data to change a detonation (e.g., stop a detonation, start a detonation, alter a rate of detonation, alter a directionality of a detonation, and/or the like).

Additionally, or alternatively, based on feedback imaging data identifying a result of a first deflagration stage associated with a first detonation of a portion of the energetic charge, control device 210 may determine to detonate another portion of the energetic charge to cause a second deflagration stage. Similarly, based on feedback pressure data, seismic data, flow rate data, burn rate data, and/or the like from one or more sensor devices 220, control device 210 may determine to detonate a portion of the energetic charge, a particular flow rate of the energetic charge, a particular pattern of ignition positions on the energetic charge, and/or the like. For example, control device 210 may periodically, continuously, and/or the like recalculate rise times, fracture propagation lengths, energy densities, and/or the like as described herein. In this case, control device 210 may use feedback data to determine a current fracture length, a current pressure, a current remaining energy of the energetic charge, and/or the like, and may alter an ignition characteristic of the energetic charge. For example, control device 210 may alter a portion of the energetic charge being ignited, an injection of particles of the energetic charge into a fracture, an amount of oxygen pumped into a borehole to enable deflagration, and/or the like, thereby enabling rise time control, fracture length propagation control, and/or the like.

In this way, control device 210 may detonate the energetic charge and, in some implementations, may re-detonate the energetic charge based on received feedback information.

Although FIG. 6 shows example blocks of process 600, in some implementations, process 600 may include additional blocks, fewer blocks, different blocks, or differently arranged blocks than those depicted in FIG. 6. Additionally, or alternatively, two or more of the blocks of process 600 may be performed in parallel.

Figure 7:
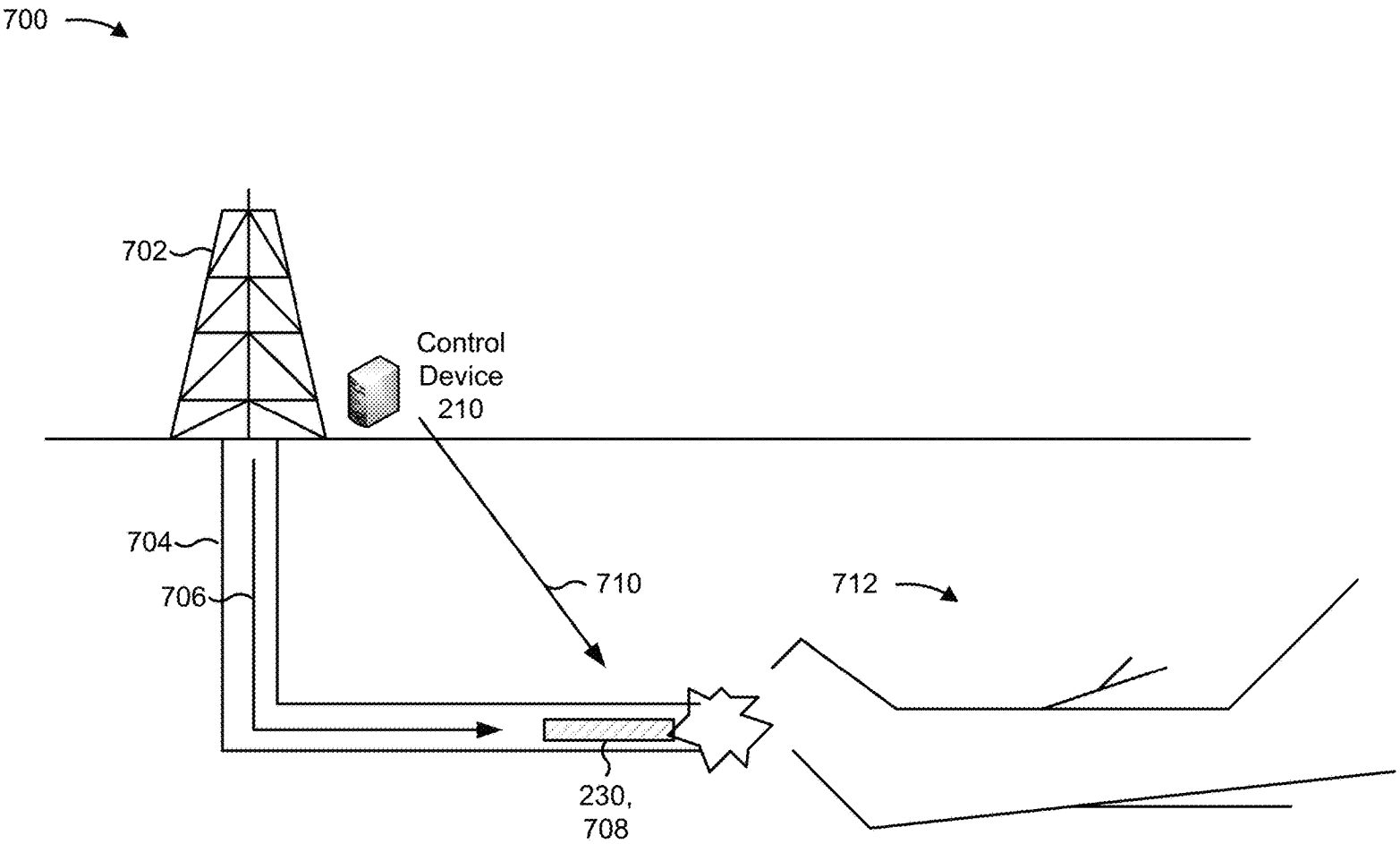
FIG. 7 is a diagram of an example implementation relating to the example process shown in FIG. 6.

FIG. 7 is a diagram of an example implementation 700 relating to example process 600 shown in FIG. 6. FIG. 7 shows an example of propellant fracturing. As shown in FIG. 7, example implementation 700 may include a borehole platform 702, a borehole 704, and a control device 210. Borehole platform 702 may be associated with one or more items of equipment, such as drilling equipment, energetic charge insertion equipment, and/or the like.

As further shown in FIG. 7, and by reference number 706, energetic charge 708 and an associated ignition device 230 are inserted into borehole 704. For example, based on control device 210 selecting a particular energetic charge configuration from a set of candidate energetic charge configurations, energetic charge 708 may be manufactured using the particular energetic charge configuration, and may be inserted into borehole 704, which may be drilled with a particular borehole diameter or borehole profile (e.g., vertical depth, lateral extension, and/or the like) selected by control device 210. As shown by reference number 710, control device 210 may provide an instruction to ignite energetic charge 708 to ignition device 230. For example, control device 210 may provide an electrical signaling indicating that ignition device 230 is to ignite energetic charge 708. In this case, based on the instruction, ignition device 230 may ignite energetic charge 708, which may cause a set of fractures 712, thereby enabling natural resource extraction.

As indicated above, FIG. 7 is provided merely as an example. Other examples are possible and may differ from what was described with regard to FIG. 7.

Figure 8A:
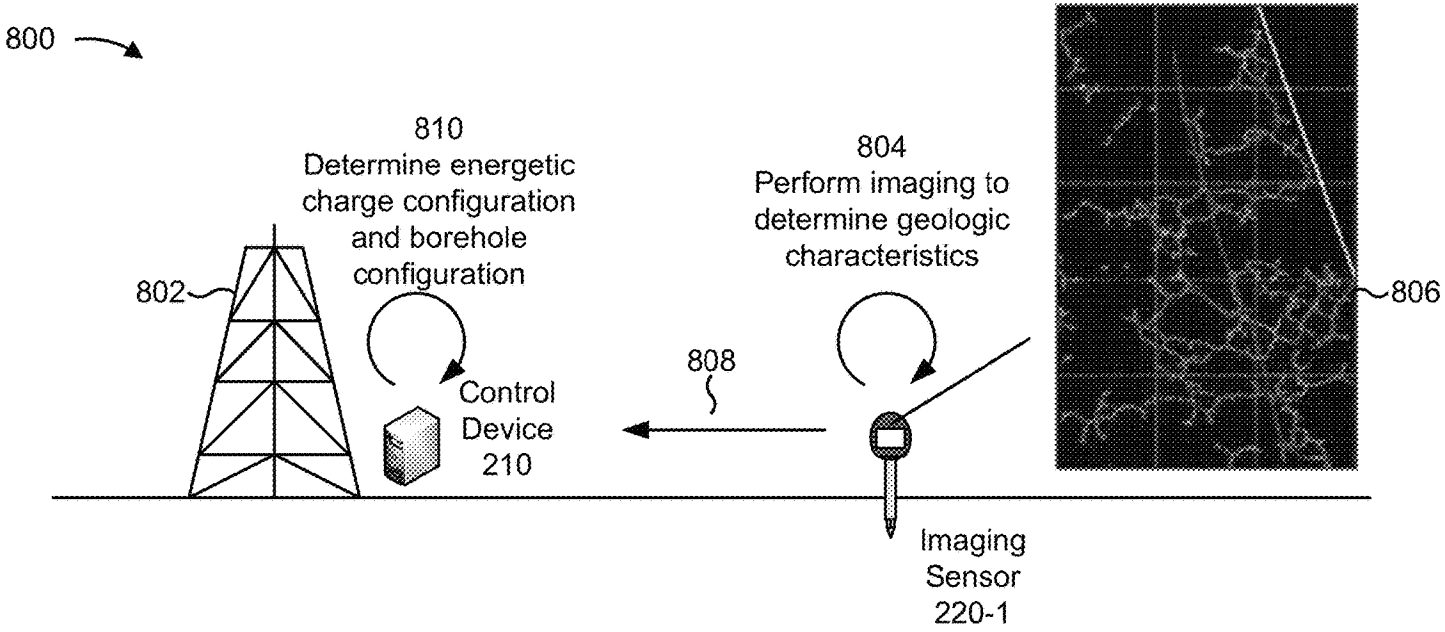
FIGS. 8A-8C are diagrams of an example implementation relating to the example process shown in FIG. 6.
Figure 8B:
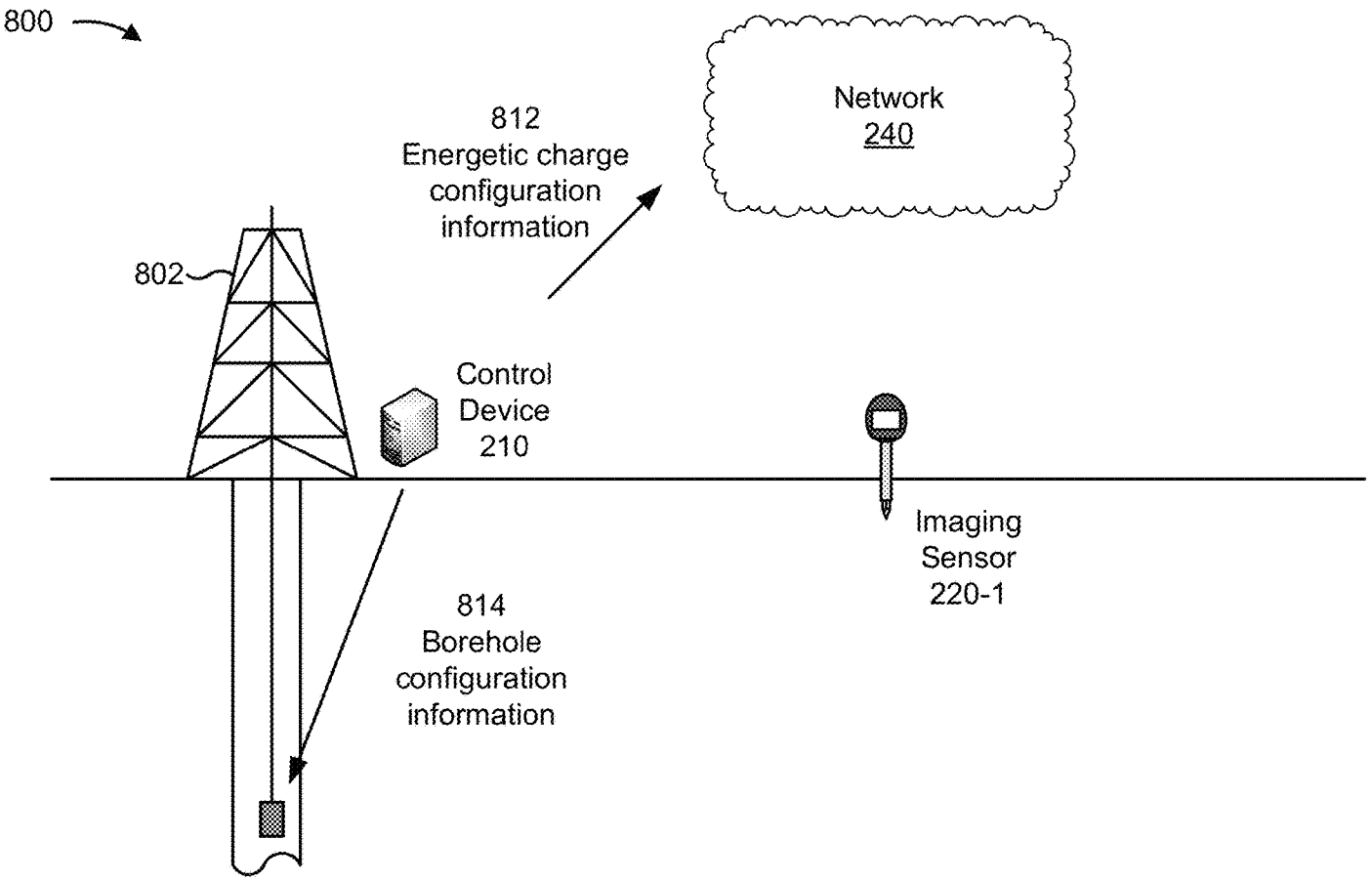
Figure 8C:
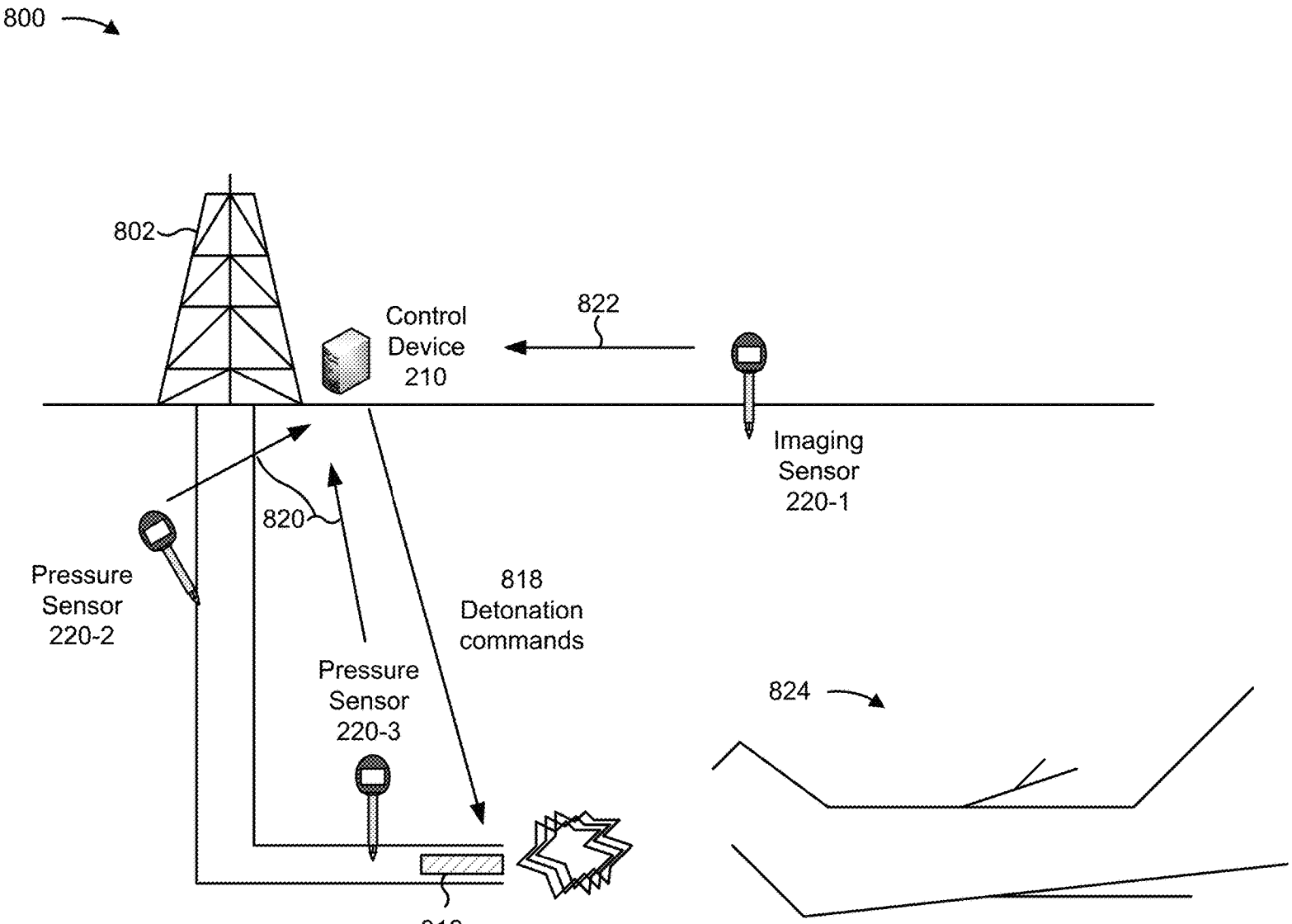

FIGS. 8A-8C are diagrams of an example implementation 800 relating to example process 600 shown in FIG. 6. FIGS. 8A-8C show an example of propellant fracturing. As shown in FIG. 8A, example implementation 800 may include a borehole platform 802, control device 210, and a set of sensors 220.

As further shown in FIG. 8A, and by reference number 804, imaging sensor 220-1 may perform imaging to determine one or more geologic characteristics of an underground rock formation. For example, based on receiving an instruction from control device 210 to perform imaging, imaging sensor 220-1 may perform the imaging to generate sensor data 806 (e.g., an image of the underground rock formation, a stress field, and/or characteristics thereof). In this case, imaging sensor 220-1 may capture information identifying an orientation of a fracture, and provide the information to control device 210 to enable control device 210 to alter a deflagration to extend the fracture, alter a direction of propagation of the fracture, and/or the like. As shown by reference number 808, control device 210 may receive information identifying a result of the imaging, such as information identifying sensor data 806, information identifying a characteristic determined based on sensor data 806, and/or the like. As shown by reference number 810, control device 210 may determine an energetic charge configuration and a borehole configuration based on sensor data 806. For example, control device 210 may calculate a borehole diameter and a rise time to achieve propellant fracturing based on characteristics of the underground rock formation determined based on sensor data 806.

As shown in FIG. 8B, and by reference number 812, based on determining the energetic charge configuration, control device 210 may provide energetic charge configuration information (e.g., via network 240). For example, control device 210 may transmit information associated with triggering manufacture of an energetic charge, selecting the energetic charge from a group of energetic charges and shipping the energetic charge to the location at which drilling is to occur, and/or the like. In some implementations, control device 210 may provide a user interface identifying instructions for configuring the energetic charge, such as instructions for coupling an ignition device 230 to the energetic charge to achieve a desired rise time or to enable control of deflagration to achieve the desired rise time. As shown by reference number 814, control device 210 may provide borehole configuration information, such as to surface equipment associated with borehole platform 802. For example, control device 210 may automatically control a drill to cause a borehole of a determined diameter, depth, profile, and/or the like to be drilled using drilling equipment. Additionally, or alternatively, control device 210 may provide, via a user interface, information identifying a borehole configuration to enable drilling technicians to drill a borehole corresponding to the borehole configuration.

As shown in FIG. 8C, an energetic charge 816 with an ignition device 230 may be inserted into the borehole based on control device 210 providing the borehole configuration information to enable drilling of the borehole. As shown by reference number 818, control device 210 may provide one or more detonation commands. For example, control device 210 may provide a first detonation command to cause a first ignition of energetic charge 816 by ignition device 230. In this way, control device 210 may cause a first deflagration, which may cause control device 210 to receive sensor data 820 and 822. For example, control device 210 may receive sensor data from pressure sensors 220-2 and 220-3, and may determine a rise time associated with the first deflagration. Additionally, or alternatively, control device 210 may receive sensor data from imaging sensor 220-1 and may determine a set of fractures 824 caused by the first deflagration. In this case, control device 210 may transmit one or more second detonation commands to cause one or more second deflagrations, thereby achieving a determined rise time and enabling propagation of fractures to a threshold length.

As indicated above, FIGS. 8A-8C are provided merely as examples. Other examples are possible and may differ from what was described with regard to FIGS. 8A-8C.

Figure 9:
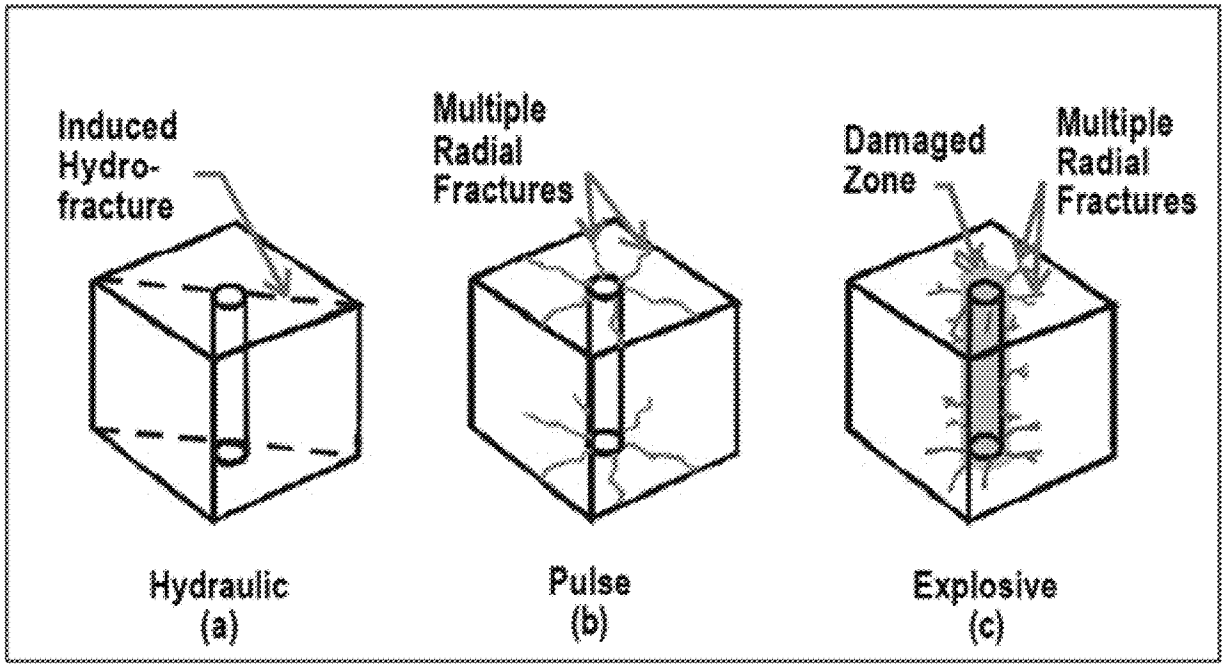
FIG. 9 is a diagram of characteristics relating to the example process shown in FIG. 6.

FIG. 9 is a diagram 900 of example characteristics relating to example process 600 shown in FIG. 6.

As shown in FIG. 9, and by diagram 900, using control device 210 to control fracturing to achieve propellant fracturing (b), such as by causing an energetic charge to have multiple deflagration stages (e.g., "pulses") rather than hydraulic fracturing (a) and/or explosive fracturing (c), results in improved control of fracture propagation. For example, induced hydraulic fracturing may result in a single linear propagation of fractures and explosive fracturing may result in multiple, semi-randomly arranged radial fractures of less than a threshold length extending out from a "damaged zone" (i.e., a zone where crushed rock from the explosive fracturing may reseal fractures around the borehole). In contrast, pulsed hydraulic fracturing results in multiple radially arranged fractures extending greater than a threshold length from the borehole.

As indicated above, FIG. 9 is provided merely as an example. Other examples are possible and may differ from what was described with regard to FIG. 9.

In this way, control device 210 enables fracturing of rock formations using reduced water consumption, improved control of fracture propagation, and reduced time to achieve fracture propagation relative to hydraulic fractures. Moreover, control device 210 reduces a likelihood of inadvertently causing hydraulic fracturing or explosive fracturing when attempting to perform propellant fracturing relative to performing propellant fracturing without performing a rise time calculation and/or receiving feedback relating to the rise time to control one or more deflagrations. Furthermore, control device 210 enables increased fracture propagation length relative to other techniques for propellant fracturing.

The foregoing disclosure provides illustration and description, but is not intended to be exhaustive or to limit the implementations to the precise form disclosed. Modifications and variations are possible in light of the above disclosure or may be acquired from practice of the implementations.

As used herein, the term component is intended to be broadly construed as hardware, firmware, or a combination of hardware and software.

Some implementations are described herein in connection with thresholds. As used herein, satisfying a threshold may refer to a value being greater than the threshold, more than the threshold, higher than the threshold, greater than or equal to the threshold, less than the threshold, fewer than the threshold, lower than the threshold, less than or equal to the threshold, equal to the threshold, or the like.

Certain user interfaces have been described herein and/or shown in the figures. A user interface may include a graphical user interface, a non-graphical user interface, a text-based user interface, or the like. A user interface may provide information for display. In some implementations, a user may interact with the information, such as by providing input via an input component of a device that provides the user interface for display. In some implementations, a user interface may be configurable by a device and/or a user (e.g., a user may change the size of the user interface, information provided via the user interface, a position of information provided via the user interface, etc.). Additionally, or alternatively, a user interface may be pre-configured to a standard configuration, a specific configuration based on a type of device on which the user interface is displayed, and/or a set of configurations based on capabilities and/or specifications associated with a device on which the user interface is displayed.

It will be apparent that systems and/or methods, described herein, may be implemented in different forms of hardware, firmware, or a combination of hardware and software. The actual specialized control hardware or software code used to implement these systems and/or methods is not limiting of the implementations. Thus, the operation and behavior of the systems and/or methods were described herein without reference to specific software code—it being understood that software and hardware can be designed to implement the systems and/or methods based on the description herein.

Even though particular combinations of features are recited in the claims and/or disclosed in the specification, these combinations are not intended to limit the disclosure of possible implementations. In fact, many of these features may be combined in ways not specifically recited in the claims and/or disclosed in the specification. Although each dependent claim listed below may directly depend on only one claim, the disclosure of possible implementations includes each dependent claim in combination with every other claim in the claim set.

As used herein, the term approximately may refer to a range of +/−10%.

No element, act, or instruction used herein should be construed as critical or essential unless explicitly described as such. Also, as used herein, the articles "a" and "an" are intended to include one or more items, and may be used interchangeably with "one or more." Furthermore, as used herein, the term "set" is intended to include one or more items (e.g., related items, unrelated items, a combination of related and unrelated items, etc.), and may be used interchangeably with "one or more." Where only one item is intended, the term "one" or similar language is used. Also, as used herein, the terms "has," "have," "having," or the like are intended to be open-ended terms. Further, the phrase "based on" is intended to mean "based, at least in part, on" unless explicitly stated otherwise.

What is claimed is:

1. An energetic charge for propellant fracturing, comprising:

a propellant material or a shape of the energetic charge being selected such that:

a rise time of a deflagration of the energetic charge is determined to be in a propellant fracturing regime, the propellant fracturing regime being defined by a set of linear equations associated with the rise time for pressure from the deflagration of the energetic charge, the rise time being calculated based on an equation, the equation being:

$$\dot{\varepsilon}=(dP/dt)/E,$$

where $\dot{\varepsilon}$ represents a strain rate, dP/dt represents a change in pressure with respect to time, and E is Young's modulus, and the set of linear equations including:

$$D=M*t, \text{ and}$$

$$D=N*t,$$

where t represents the rise time, D represents a borehole diameter, M represents a first coefficient, and N represents a second coefficient.

2. The energetic charge of claim 1, where the propellant material or the shape of the energetic charge is selected such that a fracture length for a fracture to be achieved by the energetic charge is greater than at least one of:

15 meters, 20 meters, 25 meters, 50 meters, or 100 meters.

3. The energetic charge of claim 1, wherein the energetic charge is associated with a casing, the casing including an axial opening to direct fractures axially from the energetic charge, or the casing including one or more perforations to direct fractures radially from the energetic charge.

4. The energetic charge of claim 1, where the propellant material or the shape of the energetic charge is selected to cause a plurality of deflagration stages and at least one control period between at least two of the plurality of deflagration stages.

5. The energetic charge of claim 1, where the propellant material is a particle based propellant for injection into a fracture for deflagration.

6. The energetic charge of claim 1, where the propellant material or the shape of the energetic charge is selected such that the energetic charge can be inserted into a vertical borehole to cause a plurality of lateral fractures.

7. A non-transitory computer-readable medium storing instructions, the instructions comprising:

one or more instructions that, when executed by one or more processors of a device coupled to an energetic charge, cause the one or more processors to:

determine a first configuration for a first deflagration of the energetic charge;

transmit, to the energetic charge, a first signal associated with triggering the first deflagration of the energetic charge in a borehole at a location for propellant fracturing based on the first configuration;

communicate with one or more sensor devices associated with the location for propellant fracturing to obtain sensor data regarding the first deflagration of the energetic charge;

determine a second configuration for a second deflagration of the energetic charge based on the sensor data; and transmit, to the energetic charge, a second signal associated with triggering the second deflagration of the energetic charge.

8. The non-transitory computer-readable medium of claim 7, where the one or more instructions, when executed by the one or more processors, further cause the one or more processors to:

determine one or more characteristics associated with the location for propellant fracturing;

determine a rise time to achieve propellant fracturing at the location based on the one or more characteristics;

identify a plurality of candidate energetic charge configurations;

select, from the plurality of candidate energetic charge configurations, a particular energetic charge configuration based on:

the rise time to achieve propellant fracturing, and the one or more characteristics associated with the location; and provide information identifying the particular energetic charge configuration based on selecting the particular energetic charge configuration to cause the energetic charge to be positioned in the borehole; and where the one or more instructions, that cause the one or more processors to determine the first configuration for the first deflagration, are to:

determine the first configuration based on the energetic charge being positioned in the borehole.

9. The non-transitory computer-readable medium of claim 8, where the one or more instructions, that cause the one or more processors to select the particular energetic charge configuration, cause the one or more processors to:

select the particular energetic charge configuration such that:

the rise time of the first deflagration and the second deflagration is determined to be in a propellant fracturing regime, the propellant fracturing regime being defined by a set of linear equations associated with the rise time, the rise time being calculated based on an equation:

$$\dot{\varepsilon}=(dP/dt)/E,$$

where $\dot{\varepsilon}$ represents a strain rate, dP/dt represents a change in pressure with respect to time, and E is Young's modulus, and where the set of linear equations relate the rise time to a borehole diameter.

10. The non-transitory computer-readable medium of claim 7, where the one or more instructions, where the one or more instructions, when executed by the one or more processors, further cause the one or more processors to:

transmit a third signal, based on other sensor data, to stop deflagration of the energetic charge.

11. The non-transitory computer-readable medium of claim 7, where the one or more instructions, that cause the one or more processors to communicate with one or more sensor devices, cause the one or more processors to:

communicate with an imaging sensor to obtain imaging relating to the location for propellant fracturing, the imaging identifying a characteristic of a fracture; and where the one or more instructions, that cause the one or more processors to determine the second configuration, cause the one or more processors to:

determine the second configuration to extend a length of the fracture based on the imaging identifying the characteristic of the fracture.

12. The non-transitory computer-readable medium of claim 7, where the one or more instructions, that cause the one or more processors to transmit the first signal, cause the one or more processors to:

transmit a plurality of first signals to ignite a plurality of portions of the energetic charge to trigger the first deflagration.

13. The non-transitory computer-readable medium of claim 7, where the one or more instructions, that cause the one or more processors to transmit the second signal, cause the one or more processors to:

transmit the second signal a threshold period of time after the first signal, the threshold period of time being determined based on an amount of time for a fluid to enter a fracture associated with the first deflagration.

14. The non-transitory computer-readable medium of claim 7, where the one or more instructions, that cause the one or more processors to transmit the second signal, cause the one or more processors to:

transmit the second signal to alter a flow rate of propellant of the energetic charge into a fracture associated with the first deflagration.

15. A device, comprising:

one or more memories; and one or more processors, communicatively coupled to the one or more memories, to:

determine one or more characteristics associated with a location for propellant fracturing;

determine a rise time to achieve propellant fracturing at the location based on the one or more characteristics;

identify a plurality of candidate energetic charge configurations for an energetic charge to perform propellant fracturing;

select, from the plurality of candidate energetic charge configurations, a particular energetic charge configuration based on the rise time to achieve propellant fracturing and the one or more characteristics associated with the location;

provide information identifying the particular energetic charge configuration based on selecting the particular energetic charge configuration; and provide detonation commands to cause a plurality of deflagrations of the energetic charge and achieve the rise time.

16. The device of claim 15, where the one or more processors, when determining the rise time, are to:

determine the rise time based on a borehole diameter for a borehole into which the energetic charge is to be inserted.

17. The device of claim 15, where the one or more processors are to:

determine a fracture length that is to be achieved by the energetic charge; and where the one or more processors, when selecting the particular energetic charge configuration, are to:

select the particular energetic charge configuration based on the fracture length.

18. The device of claim 17, where the one or more processors, when selecting the particular energetic charge configuration, are to:

determine that the particular energetic charge configuration is to achieve the fracture length based on an energy density of the particular energetic charge configuration and the rise time.

19. The device of claim 15, where the rise time relates to a borehole diameter of a borehole into which the energetic charge is to be inserted based on a propellant fracturing regime.

20. The device of claim 15, where the energetic charge is a first energetic charge; and where the one or more processors, are further to:

transmit a signal to a second energetic charge to cause another deflagration from the second energetic charge.

* * * * *